US007559533B2

(12) United States Patent
Stockmaster et al.

(10) Patent No.: US 7,559,533 B2
(45) Date of Patent: Jul. 14, 2009

(54) LIFT ACTUATOR

(75) Inventors: James Stockmaster, Macedon, NY (US); Jim Alday, Honeoye Falls, NY (US); Brian Peets, Fairport, NY (US); Peter Liu, Brighton, NY (US); Robert DeVoria, Penfield, NY (US); John Pembroke, Farmington, NY (US); Blake Reese, Honeoye Falls, NY (US)

(73) Assignee: Gorbel, Inc., Fishers, NY (US)

( * ) Notice: Subject to any disclaimer, the term of this patent is extended or adjusted under 35 U.S.C. 154(b) by 70 days.

(21) Appl. No.: 11/623,710

(22) Filed: Jan. 16, 2007

(65) Prior Publication Data

US 2007/0205405 A1 Sep. 6, 2007

Related U.S. Application Data

(63) Continuation-in-part of application No. 29/256,812, filed on Mar. 24, 2006, now Pat. No. Des. 543,003, and a continuation-in-part of application No. 29/256,811, filed on Mar. 24, 2006, now Pat. No. Des. 543,334.

(60) Provisional application No. 60/759,462, filed on Jan. 17, 2006.

(51) Int. Cl.
*B66D 1/00* (2006.01)

(52) U.S. Cl. ..... 254/270; 414/5; 212/285

(58) Field of Classification Search ..... 254/270, 254/274, 275, 331, 333; 414/2, 4, 5; 212/331, 212/330, 338, 285
See application file for complete search history.

(56) References Cited

U.S. PATENT DOCUMENTS 2,636,953 A 4/1953 Hunt
2,940,608 A 6/1960 Underwood et al.
2,991,976 A 7/1961 Carroll
3,163,399 A 12/1964 Skerry
3,182,962 A 5/1965 Gray
3,258,248 A 6/1966 Lerch et al.
3,286,989 A 11/1966 Bangerter et al.
3,325,148 A 6/1967 Powell (Continued)

OTHER PUBLICATIONS

AmCells Co; American Load Cells; Product Categories; List and Specifications of products; www.amcells.com/products.htm; Oct. 29, 2001.

(Continued)

*Primary Examiner*—Emmanuel M Marcelo
(74) *Attorney, Agent, or Firm*—Duane C. Basch; Basch & Nickerson LLP

(57) ABSTRACT

An improved electric lift actuator for use on a variety of lift systems, includes various improvements that enable a universal design with interchangeable parts across several load ranges. The universal design further enables additional features and functionality (e.g., improved load cell location, improved operator sensing and electrical signal/air channel in operator pendant, improved reliability and reduced cost for operator force sensing, etc.) In addition the universal design is incorporated with a rotational drive assembly wherein the load sensing and wire rope slack sensing, as well as cable limits may be achieved using improved components and techniques—such as non-contact sensors, etc. Many of the improvements described are believed to reduce cost and improve the performance and expand the capacity and reliability of the actuator in addition to making the actuator a common design across several applications and load ranges.

20 Claims, 29 Drawing Sheets

*FIG. 1*

U.S. PATENT DOCUMENTS

| | | | | |
|---|---|---|---|---|
| 3,384,350 | A | 5/1968 | Powell | |
| 3,421,737 | A | 1/1969 | Ulbing | |
| 3,608,743 | A | 9/1971 | Mosher et al. | |
| 3,637,092 | A | 1/1972 | George et al. | |
| 3,654,415 | A | 4/1972 | Hawkins et al. | |
| 3,755,725 | A | 8/1973 | Cordes | |
| 3,773,296 | A | 11/1973 | McKendrick | |
| 3,907,120 | A | 9/1975 | Johnston et al. | |
| 3,921,959 | A | 11/1975 | Ulbing | |
| 3,933,388 | A | 1/1976 | Conboy | |
| 4,295,771 | A | 10/1981 | Mehesan | |
| 4,500,074 | A | 2/1985 | Fox et al. | |
| 4,557,659 | A | 12/1985 | Scaglia | |
| 4,562,430 | A | 12/1985 | Robinson | |
| 4,636,962 | A | 1/1987 | Broyden et al. | |
| 4,646,087 | A | 2/1987 | Schumann | |
| 4,762,199 | A | 8/1988 | Holmes | |
| 4,789,135 | A | 12/1988 | Watanabe | |
| 4,844,421 | A | 7/1989 | Kojima | |
| 4,917,360 | A | 4/1990 | Kojima | |
| 5,058,468 | A | 10/1991 | Lessway | |
| D336,713 | S | 6/1993 | Avitan et al. | |
| 5,261,026 | A | 11/1993 | Tomaru et al. | |
| D346,758 | S | 5/1994 | Adler | |
| 5,350,075 | A | 9/1994 | Kahlman | |
| 5,437,432 | A | 8/1995 | Fujikwa | |
| 5,480,125 | A | 1/1996 | Bitsch et al. | |
| 5,520,368 | A | 5/1996 | Braesch et al. | |
| 5,522,581 | A | 6/1996 | Kulhavy | |
| 5,632,469 | A | 5/1997 | Heun et al. | |
| 5,650,704 | A | 7/1997 | Pratt et al. | |
| 5,707,094 | A | 1/1998 | Gower | |
| 5,848,781 | A | 12/1998 | Kulhavy | |
| 5,850,928 | A | 12/1998 | Kahlman et al. | |
| 5,865,426 | A * | 2/1999 | Kazerooni | 254/270 |
| 5,915,673 | A | 6/1999 | Kazerooni | |
| 5,967,580 | A | 10/1999 | Rosheim | |
| 6,140,787 | A | 10/2000 | Lokhorst et al. | |
| 6,241,462 | B1 | 6/2001 | Wannasuphoprasit et al. | |
| D445,232 | S | 7/2001 | Price | |
| 6,271,828 | B1 | 8/2001 | Rosenberg et al. | |
| 6,299,139 | B1 * | 10/2001 | Kazerooni | 254/270 |
| 6,386,513 | B1 | 5/2002 | Kazerooni | |
| D477,901 | S | 7/2003 | Robinson | |
| 6,595,493 | B2 | 7/2003 | Krebs et al. | |
| 6,622,990 | B2 | 9/2003 | Kazerooni | |
| 6,634,621 | B2 | 10/2003 | Keith | |
| D499,523 | S | 12/2004 | Werner et al. | |
| 6,907,317 | B2 | 6/2005 | Peshkin et al. | |
| 6,916,015 | B2 | 7/2005 | Andreasson | |
| 6,928,336 | B2 | 8/2005 | Peshkin et al. | |
| D526,757 | S | 8/2006 | Bergman et al. | |
| 7,090,200 | B2 | 8/2006 | Morse et al. | |
| 2003/0047726 | A1 | 3/2003 | Nam | |
| 2003/0196857 | A1 | 10/2003 | Tiner | |
| 2004/0035181 | A1 | 2/2004 | Deruiter et al. | |
| 2005/0179020 | A1 | 8/2005 | Taylor et al. | |

OTHER PUBLICATIONS

Bando I-Lifter; Intelligent Lifter i-Lifter; Ci-Type Chain Hoist; www.bandohoist.com; www.bandocranes.cn; 2 pages.

Cobotics' iLift and iTrolley Win Good Design Award; Cobotics; www.cobotics.com; c. Cobotics 2002 4 pages.

Cobotics' iLift and iTrolley Win Good Design Award; Stanley assembly Technology 1 page; c. 2003-2004 The Stanley Works.

Gorbel Pendant Handle—G-Force; Optional handle gives G-Force and Easy Arm more control; www.gobel.com/gforce/wasyarm.asp; 2 pages; c. 2005.

Gorbel Cranes; Gorbel ergonomoic workstation cranes; www.gobel.com; Brochure 12 pages; c. 2003.

Gorbel G-Force Brochure; G-Force: A class above traditional lifting; 6 page brochure; www.gorbel.com/gforce.

IR Parts, Installation and Maintenance Manual for Series ZA, EA and BA Air Balancers; Form MHD56151 Edition 3 Jun. 2000; 54072541; c. 2000 Ingersoll-Rand Company.

IR- Parts, Operation and Maintenance Manual for Air Lift Balancer; Form MHD56088; Edition 2; May 1995; 71147029 c. 1995 Ingersoll-Rand company.

IR Zimmerman Intelift Control System; Webpage from Oct. 24, 2001.

Midaco Corporation; Webpage www.midaco.com>Products> MIDACO Lift L-150; MIDACO Lift L-500; c 2004 Midaco Corporation.

Soft Touch Pneumatic Control Handles; Easy Lever Press design Reduces Fatigue; www.gorbel.com; 2 page brochure.

Stanley Cobotics Web pages; Material Handling: A new solution to today's matrial handling; c. 2003 The Stanley Works.

Written Opinion and International Search Report for PCT/US2007/01220 transmitted Sep. 9, 2008.

* cited by examiner

LIFT ACTUATOR

This application claims priority from U.S. Provisional Application 60/759,462 for an "IMPROVED LIFT ACTUATOR" filed Jan. 17, 2006, and is a continuation-in-part of U.S. Design application Ser. No. 29/256,812 for an "ACTUATOR FOR A LIFTING DEVICE", filed Mar. 24, 2006, now U.S. Des. No. D543,003, and U.S. Design application Ser. No. 29/256,811 for a "HANDLE FOR A LIFTING DEVICE", filed Mar. 24, 2006, now U.S. Des. No. D543,334, all of which are hereby incorporated by reference in their entirety.

The present invention is directed to an improved lift actuator, and more specifically to an electric lift actuator for use on a variety of lift systems, wherein the actuator includes various improvements that reduce cost and improve the performance (e.g., increased overall maximum capacity) and reliability of the actuator in addition to making the actuator, end-effector and components with common designs across several applications and/or load ranges.

BACKGROUND AND SUMMARY

The use of electric lift actuators is well-known in the materials handling industry. Electric lifts are particularly useful, and have been applied in several embodiments to provide varying lift capabilities for personal lift devices for lifting and transporting loads. Examples of such devices include the Gorbel G-Force™ and Easy Arm™ systems.

More specifically, the present invention is directed to a class of material handling devices called balancers or lifts, which include a motorized lift pulley having a cable or line which, with one end fixed to the pulley, wraps around the pulley as the pulley is rotated, and an end-effector or operator control in the form of a pendant or similar electromechanical device that may be attached to the other (free or non-fixed) end of the cable. The end-effector has components that connect to the load being lifted, and the pulley's rotation winds or unwinds the line and causes the end-effector to lift or lower the load connected to it. In one mode of operation, the actuator applies torque to the pulley and generates an upward line force that exactly equals the gravity force of the object being lifted so that the tension in the line essentially balances the object's weight. Therefore, the only force the operator must impose to maneuver the object is the object's acceleration force.

In one class of systems, these devices measure the human force or motion and, based on this measurement, vary the speed or force applied by the actuator (pneumatic drive or electric drive). An example of such a device is U.S. Pat. No. 4,917,360 to Yasuhiro Kojima, U.S. Pat. No. 6,622,990 to Kazerooni, and U.S. Pat. No. 6,386,513 to Kazerooni. U.S. Pat. No. 6,622,990 for a "HUMAN POWER AMPLIFIER FOR LIFTING LOAD WITH SLACK PREVENTION APPARATUS," to Kazerooni., issued Sep. 23, 2003, is hereby incorporated by reference in its entirety. With this and with similar devices, when the human pushes upward on the end-effector the pulley turns and lifts the load; and when the human pushes downward on the end-effector, the pulley turns in the opposite direction and lowers the load. Similar operation may be observed in systems having what is frequently referred to as a "float mode" wherein an operator's application of upward or downward force to the load itself results in system-assisted movement of the load.

The embodiments disclosed herein are designed to provide several improvements to existing electric actuator and lift systems. In a general sense, the improved design facilitates the standardization of the actuator design in order to reduce the number of components required to manufacture and service a broad range of lift systems, whereby fewer components are changed between several actuators having varying load-lifting ranges. The redesign also modifies several components in the actuator and the associated user controls (e.g., operator control pendant) so as to improve the reliability, serviceability and expandability of the controls.

Disclosed in embodiments herein is a lift actuator, comprising: a controller; an electrical motor for driving the actuator, said motor operating in response to control signals from the controller, to rotate a drum upon which a wire rope, with one end fixed to the drum, is wound and unwound; and an operator interface, attached near the free end of the wire rope, said operator interface including a detachable lifting tool, wherein the operator interface provides signals from the operator to the controller to control the operation of the actuator.

Also disclosed are: a frame for rotatably suspending the motor, mechanical reduction and drum therefrom; a load sensor attached to the frame, for sensing the load as a result of rotation of the motor/reducer/drum assembly when a load is applied to the unwound end of the wire rope; a slack sensor for sensing the angle of orientation of the motor/reducer/drum assembly and determining when a slack condition is present in response to a signal from the slack sensor, mounted on the rotating assembly in one embodiment; a universal motor and reducer assembly that may be fitted with one of a plurality of additional reducers in order to alter the capacity range of the actuator; a planetary reducer, wherein the mechanical configuration of the reducer is substantially enclosed within the wire rope pulley drum; a cable guide for controlling the position and maintaining the wrap integrity (tightness) of the cable upon being wound upon or unwound from the drum; adjustable cable limit sensors, triggered in response to the extreme axial movement of the cable guide as the cable is wound and unwound; and the cable guide including a plurality of threads for mating with grooves on the drum to provide the lateral force to move the guide as the cable is wound and unwound. Said grooves also serve as location for the wire rope on the drum, yielding precise, single layer placement of the wire rope on the drum.

Further disclosed relative to various alternative embodiments of the operator interface are: a handle; a pivotable coupling for attaching the interface to the wire rope, but permitting 360-degree rotation thereof relative to the rope by way of a pancake-like slip ring suitable for providing electrical contacts and an air channel or conduit therewith; a coil sensor for sensing a vertical component of a displacement applied to the handle, wherein the handle is coupled to a core passing within the coil by a flexible filament; a liquid crystal display on the interface to display status information to an operator; a non-contact, optical proximity sensor for detecting the presence of an operator's hand on the handle during operation; and a quick-disconnect, bayonet-type or pin-type attachment for tools to be attached to the bottom of the interface.

DETAILED DESCRIPTION

To follow is a description intended to provide information related to each of the various improvements to an electric lift actuator and has been described with respect to embodiments thereof. It will, however, be appreciated that several of the improvements may be used with or implemented on other types of actuators or other load-handling equipment in general and are not specifically limited to an electric actuator or lift system as described herein. The drawings are not intended to be to scale and some features thereof may be shown in enlarged proportion for improved clarity.

Figure 1:
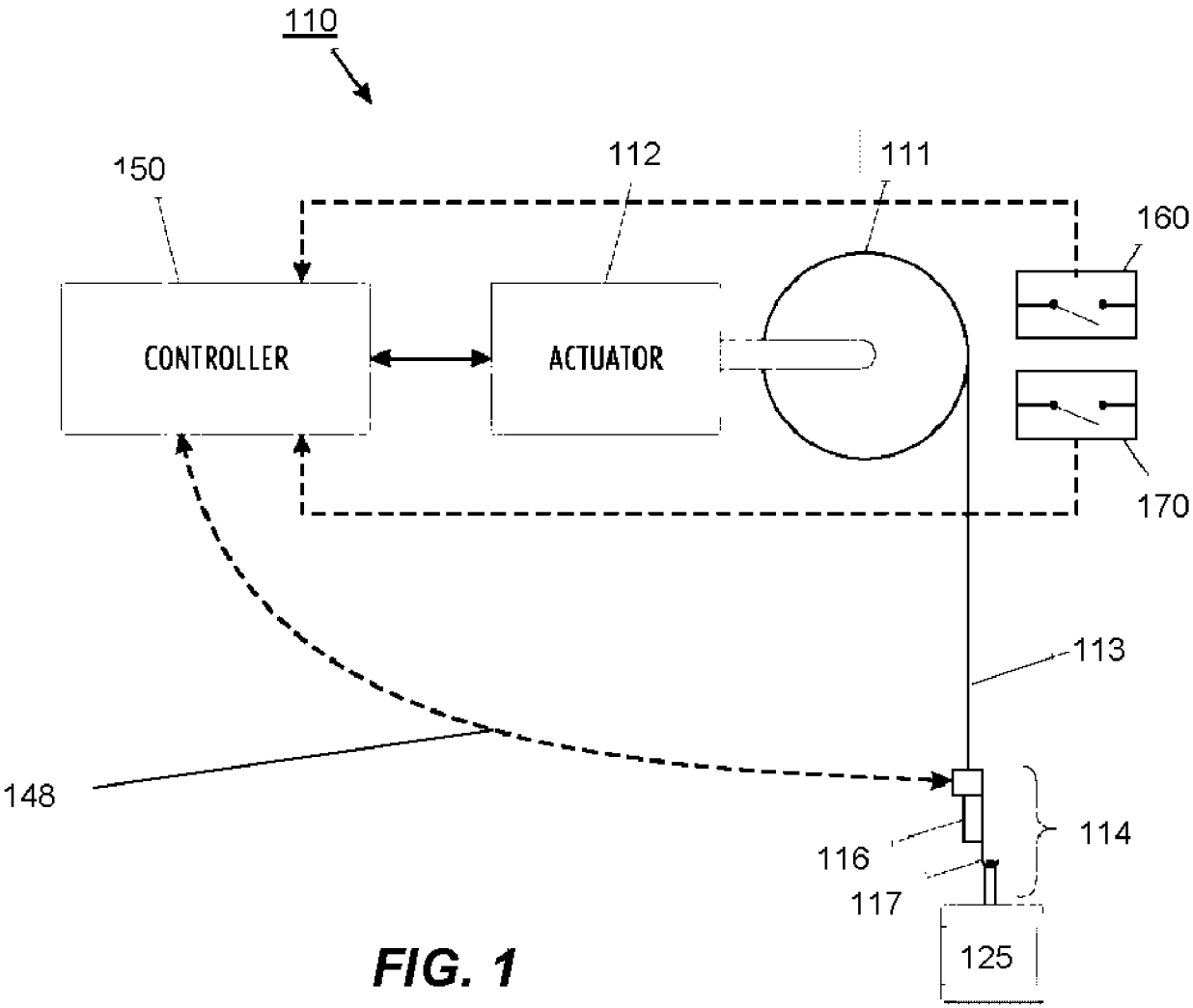
FIG. 1 is a schematic illustration of an exemplary embodiment of the present invention.

Referring to FIG. 1, there is depicted a schematic representation of an embodiment of the invention, showing a take-up or drive pulley and associated mechanical assemblies in an exemplary human power amplifier 110. At the top of the device, a take-up pulley 111, driven by an actuator 112, is attached directly to a ceiling, wall, or overhead crane, arm or similar structure (not shown). Encircling pulley 111 is a line or cable 113 having one end attached to the pulley and the opposite end free for attachment to a load. Cable 113, also referred to as a wire rope, is capable of lifting or lowering a load 125 when the pulley 111 turns. Line 113 can be any type of line, wire, cable, belt, rope, wire line, cord, twine, string, chain or other member that can be wound around a pulley or drum and can provide a lifting force to a load. Attached to line 113 is an end-effector 114, that includes a human interface subsystem (e.g. a handle or pendant 116) and a load interface subsystem 117, which in this embodiment includes a removable J-hook, but may also include a pair of suction cups or similar load grasping means. Not shown, but included in a suction cup embodiment, would be an air hose for supplying the suction cups with vacuum.

In one embodiment, actuator 112 is an electric motor with a transmission, but alternatively it can be an electrically-powered motor without a transmission. Furthermore, actuator 112 can also be powered using other types of power including pneumatic, hydraulic and other alternatives. As used herein, transmissions are mechanical devices such as gears, pulleys and the like that increase or decrease the tensile force in the line. Pulley 111 can be replaced by a drum or a winch or any mechanism that can convert the rotational or angular motion provided by actuator 112 to vertical motion that raises and lowers line 113. Although in this embodiment actuator 112 directly powers the take-up pulley 111, one can mount actuator 112 at another location and transfer power to the take-up pulley 111 via another transmission system such as an assembly of chains and sprockets. Actuator 112 preferably operates in response to an electronic controller 150 that receives signals from end-effector 114 over a signal cable (not shown), wiring harness or similar signal transmission means. It will be appreciated that there are several ways to transmit electrical signals, and the transmission means can be an alternative signal transmitting means including wireless transmission (e.g., RF, optical, etc.). One embodiment of the present invention contemplates a custom coil cord 148 in which the coiled control wiring and/or air conduit are custom molded so as to permit such a cord to retain its shape (e.g., coiled around rope 113).

Figure 10:
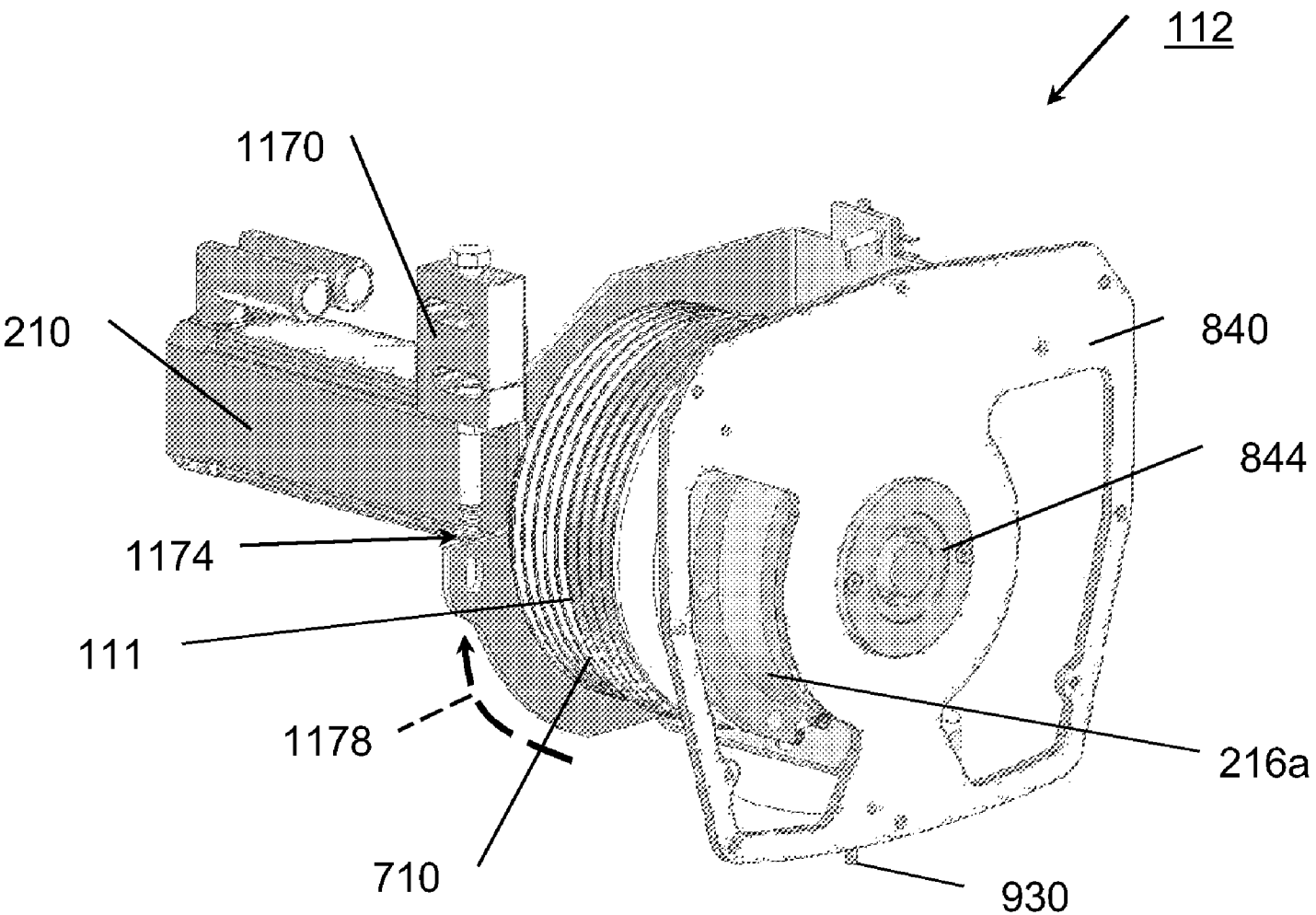
Figure 17:
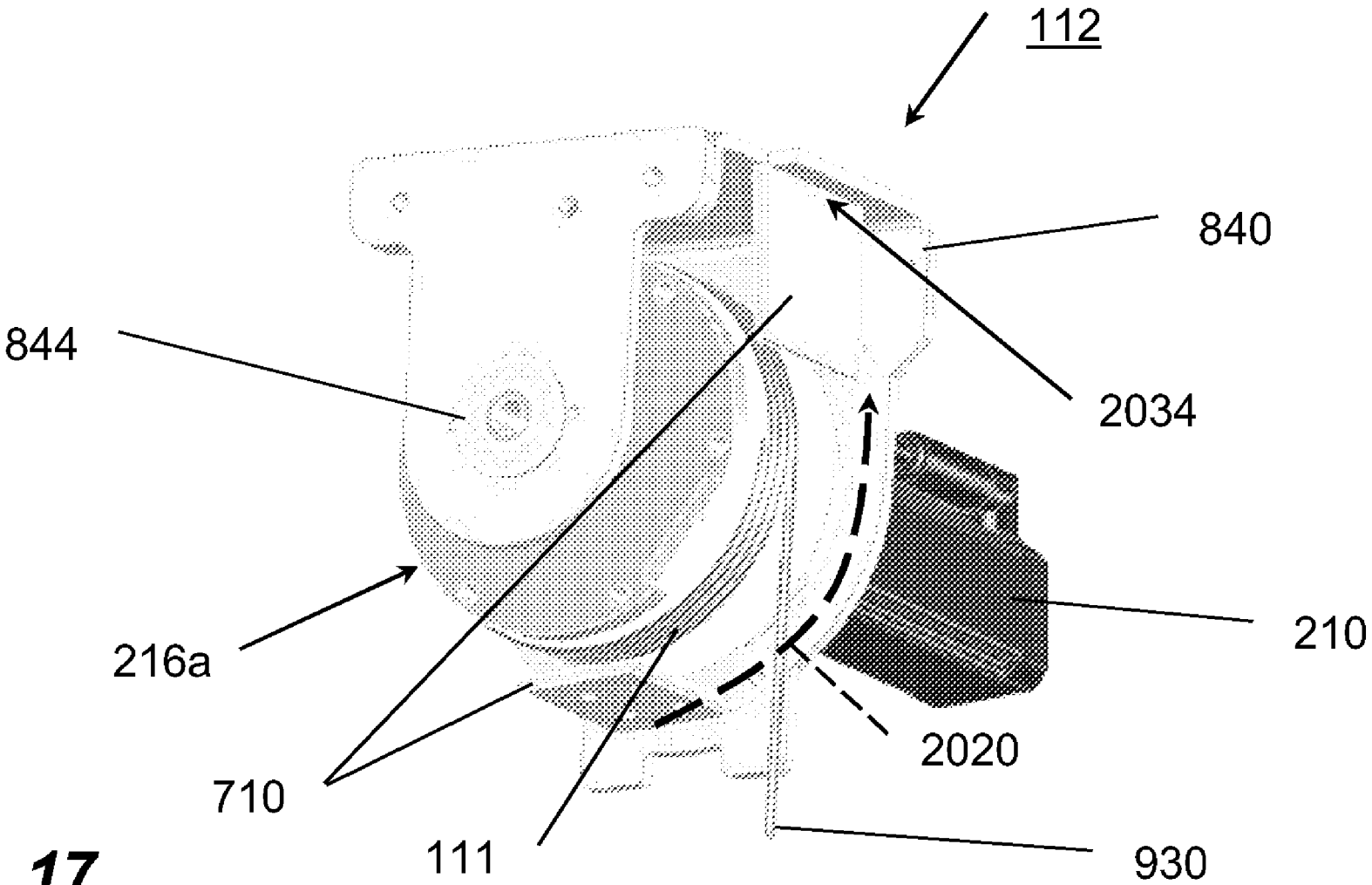
FIGS. 17-19 are detailed illustrations depicting an embodiment of the present invention directed to sensing of the potential for a slack condition of the wire rope in accordance with an aspect of the present invention.
Figure 18:
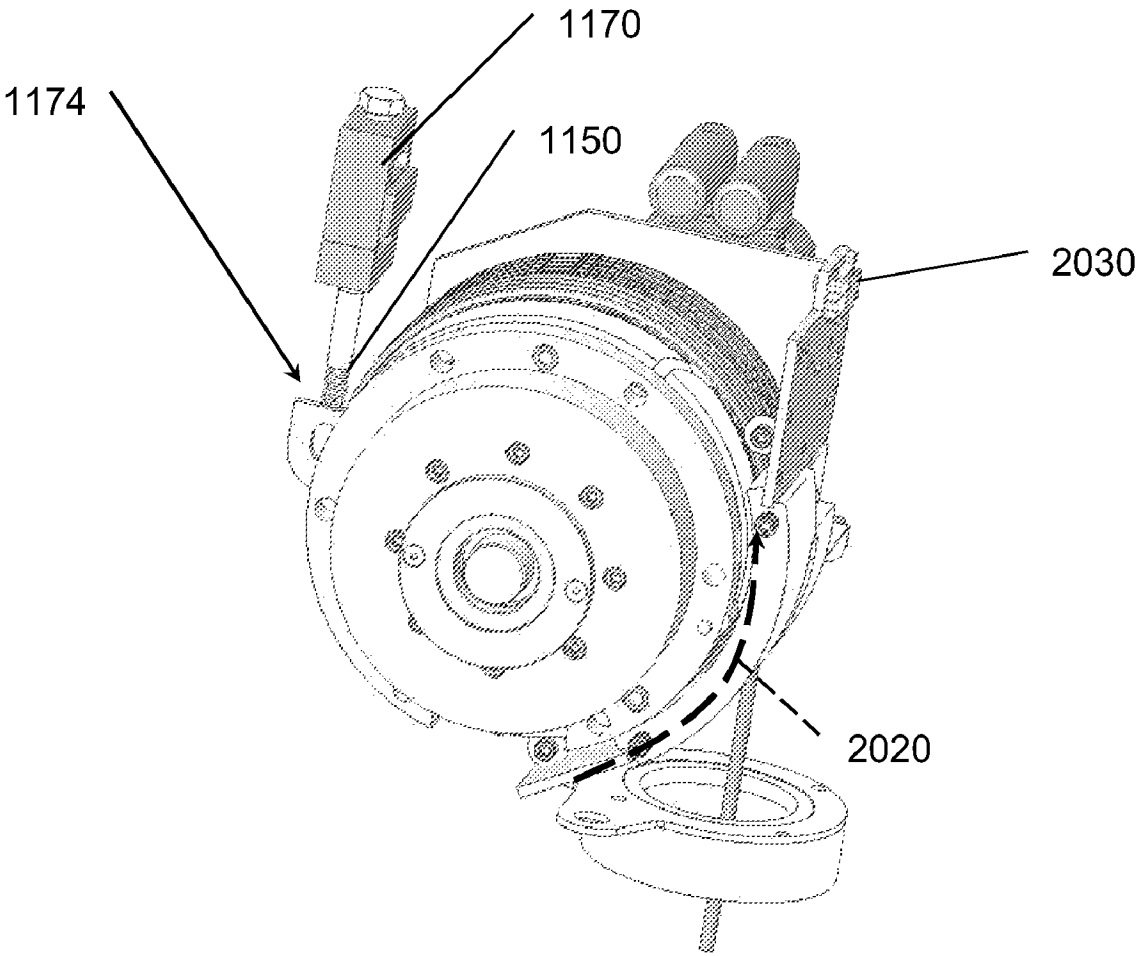
Figure 19:
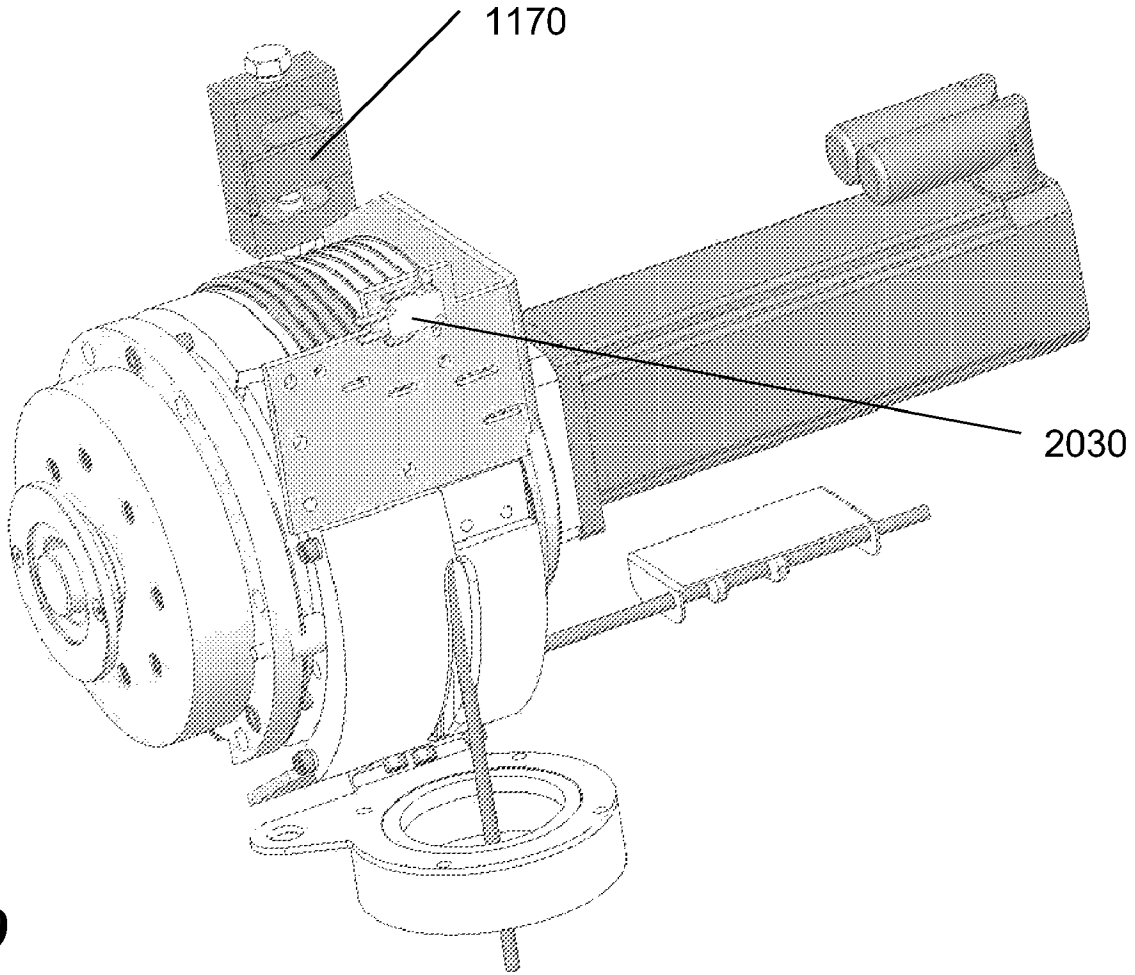
Figure 20:
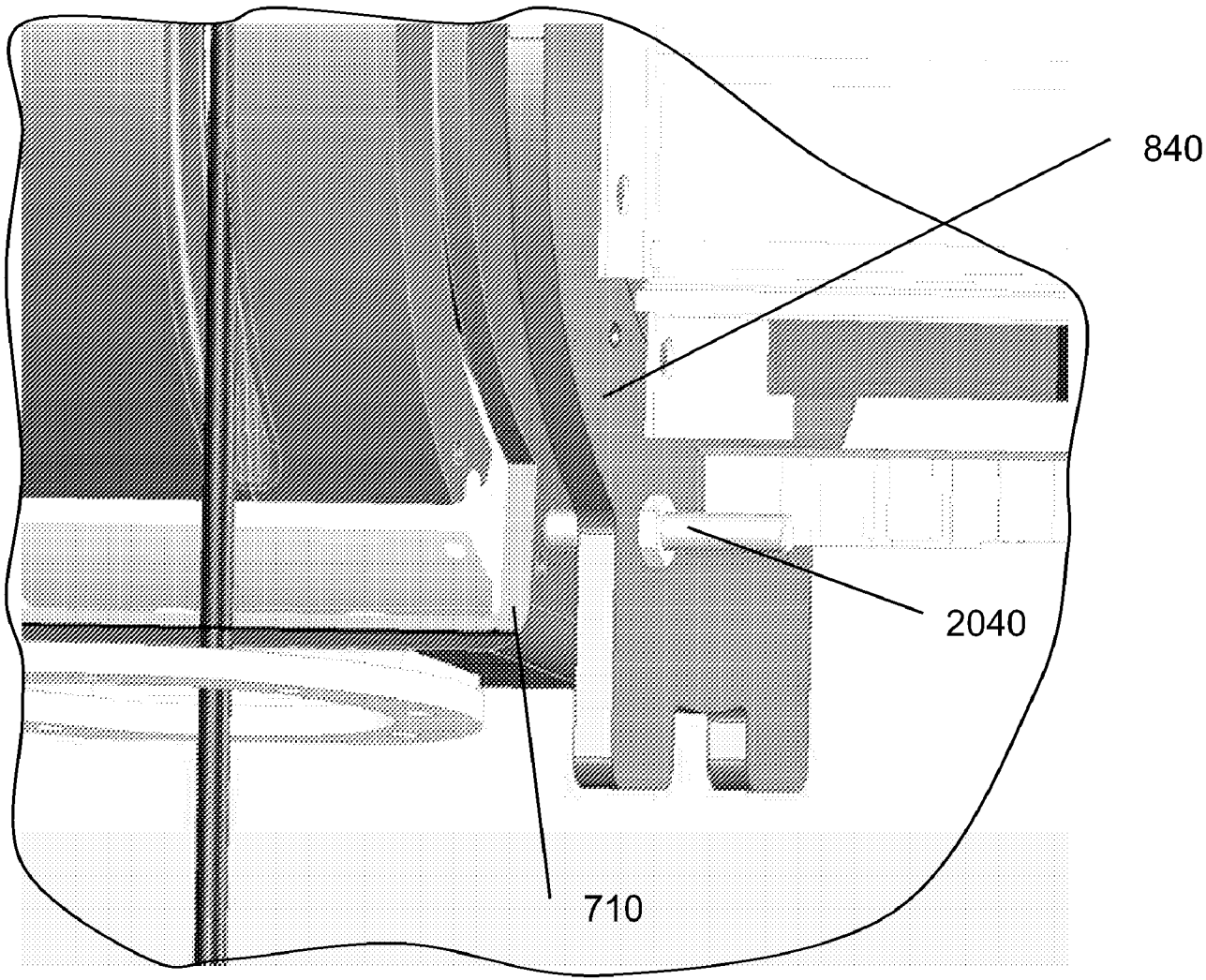
FIGS. 20-21 depict an alternative slack-sensing embodiment that may be employed in accordance with the disclosed invention.
Figure 21:
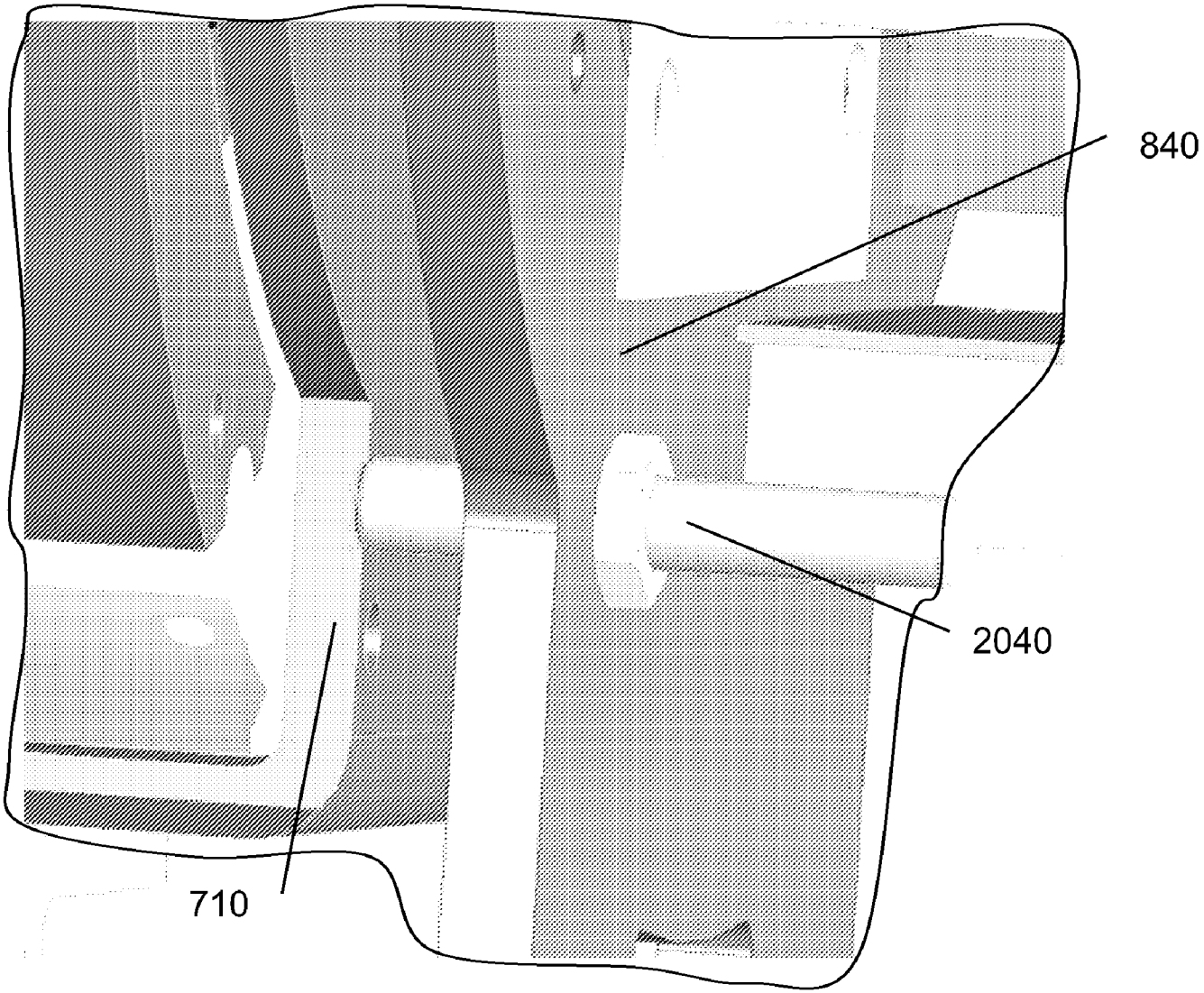
Figure 22:
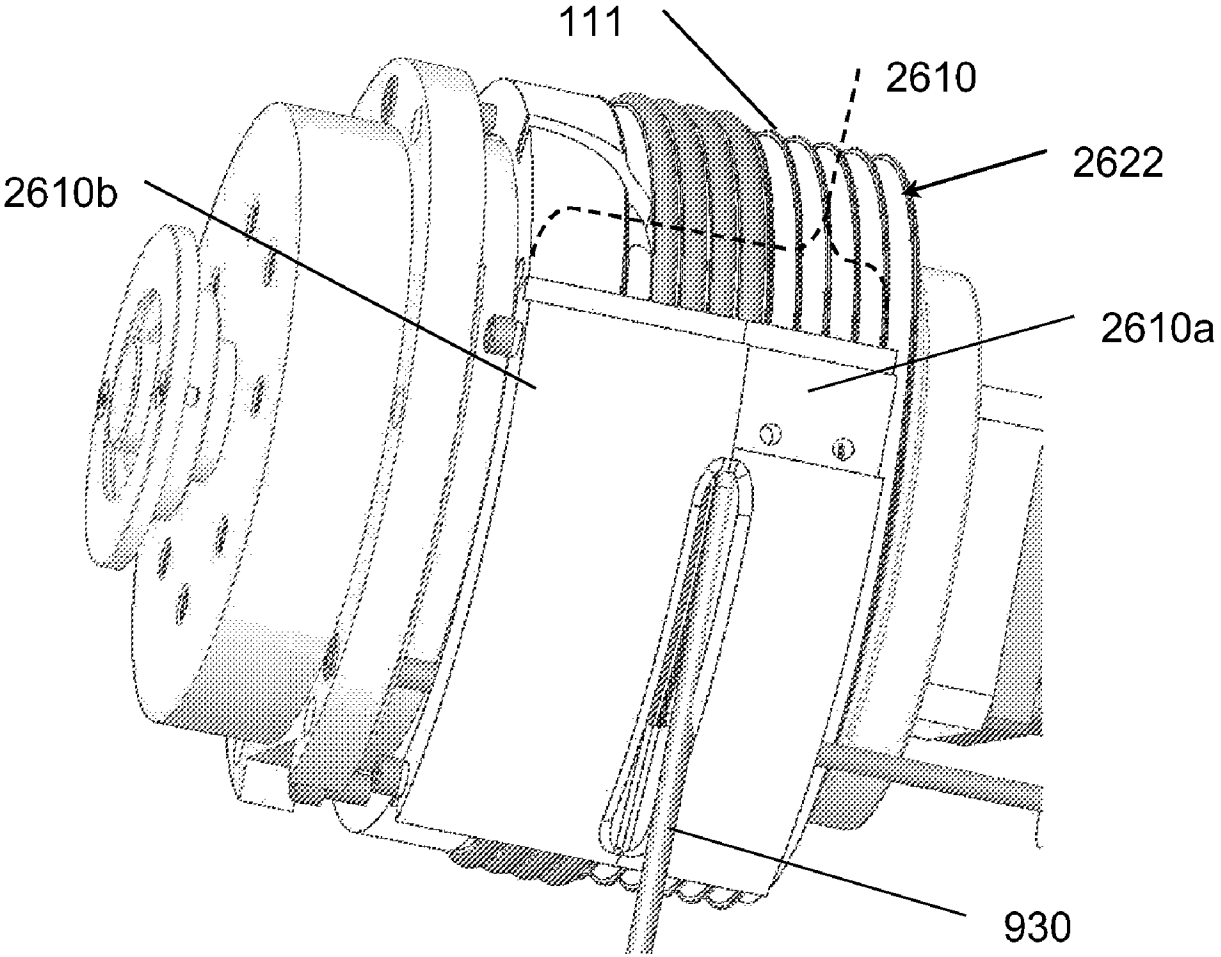
FIGS. 22-24 are detailed representations of improved cable management and drum cover features, including slack prevention, in accordance with an aspect of the present invention.
Figure 23:
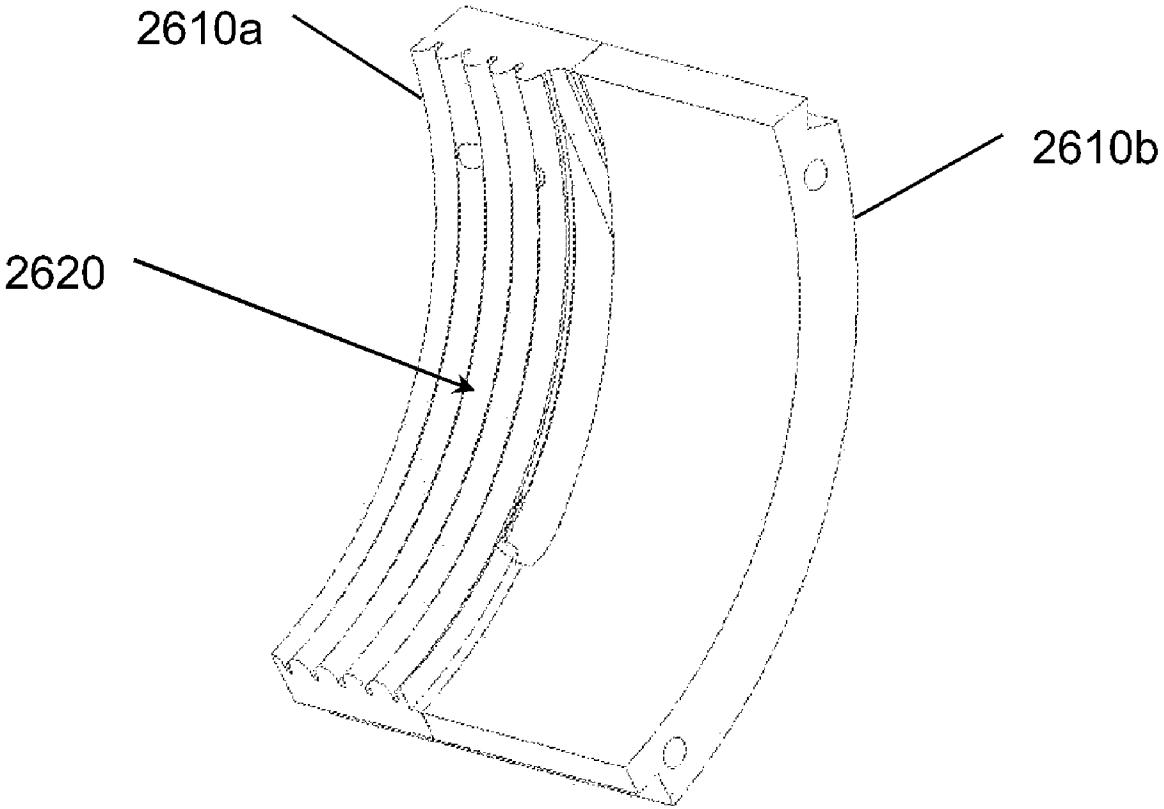

One or more sensors may be employed, in addition to the operator controls to provide functional and/or safety features to the system. For example, controller 150 may receive input from sensors (e.g., switches) such as a slack sensor 160, cable travel limit sensor 170, a load cell 1170 (e.g., FIGS. 10, 11) or an operator presence sensor 1710 (FIG. 17).

In one embodiment the controller 150 contains three primary components:

1. Control circuitry including an analog circuit, a digital circuit, and/or a computer with input output capability and standard peripherals. The function of the control circuitry is to process the information received from various inputs and to generate command signals for control of the actuator (via the power amplifier).

2. A power amplifier that sends power to the actuator in response to a command from the control circuitry (e.g., a load cell indicating the force due to the load). In general, the power amplifier receives electric power from a power supply and delivers the proper amount of power to the actuator. The amount of electric power (current and/or voltage) supplied by the power amplifier to actuator 112 is determined by the command signal generated within the computer and/or control circuitry. It will be appreciated that various motor-driver-amplifier configurations may be employed, based upon the requirements of the lift. In one embodiment, the preferred motor-drive system is the ACOPOS Servo Drive produced by B&R Automation under manufacturer's part no. 8V1016.50-2. One embodiment further contemplates the addition of other modules used in conjunction with this drive, such as a CPU (e.g., ACOPOS 8AC140 or 8AC141), I/O Module (e.g., 8AC130.60-1) and similar components to complete the controls.

3. A logic circuit composed of electromechanical or solid state relays, switches and sensors, to start and stop the system in response to a sequence of possible events. For example, the relays are used to start and stop the entire system operation using two push buttons installed either on the controller or on the end-effector. The relays also engage a friction brake (not shown) in the event of power failure or when the operator leaves the system. In general, depending on the application, various architectures and detailed designs are possible for the logic circuit. In one embodiment, the logic circuit may be similar to that employed in the G-force lift manufactured and sold by Gorbel, Inc.

As described in detail in U.S. Pat. No. 6,622,990, hereby incorporated by reference, human interface subsystem 114 may be designed to be gripped by a human hand and measures the human-applied force, i.e., the force applied by the human operator against human interface subsystem 114. In one embodiment, the human-applied force is detected by a load cell 1170 (e.g., FIGS. 10, 11) or similar output-generating sensor as described in more detail below, wherein the signal output level generated by the load sensor is a function of the load applied to the end-effector by the human and is added to or subtracted from the load being supported.

Load interface subsystem 117, as will also be described below is a removable or customizable mechanism designed to interface with a load, and contains various holding, clamping or other customized load gripping devices. The design of the load interface subsystem depends on the geometry of the load and other factors related to the lifting operation. In addition to the hook 117, other load interfaces could include suction cups as well as various hooks, clamps and grippers and similar means that connect to load interface subsystems. For lifting heavy objects, the load interface subsystem may comprise multiple load interfaces (i.e., multiple hooks, clamps, grippers, suction cups, and/or combinations thereof).

Having described the components of a lift system, attention will now be turned to the various aspects of the present invention. One aspect is what is referred to as a "building block design" for the actuator system. The building block design is generally depicted in FIGS. 2 through 6, where various aspects of the design are set forth. In the creation of the building block design the various components of a lift system (e.g., actuator, handle, gear reducers, etc.) are designed such that the components may be used on a plurality of models or types of lifts (Easy Arm™, G-Force™, etc.). Recognizing that in some situations characteristics such as lift capacity must be configured per order, the designs were also analyzed to determine which, if any, components may be employed as common or universal and which must be selected on a per-order basis.

Figure 3:
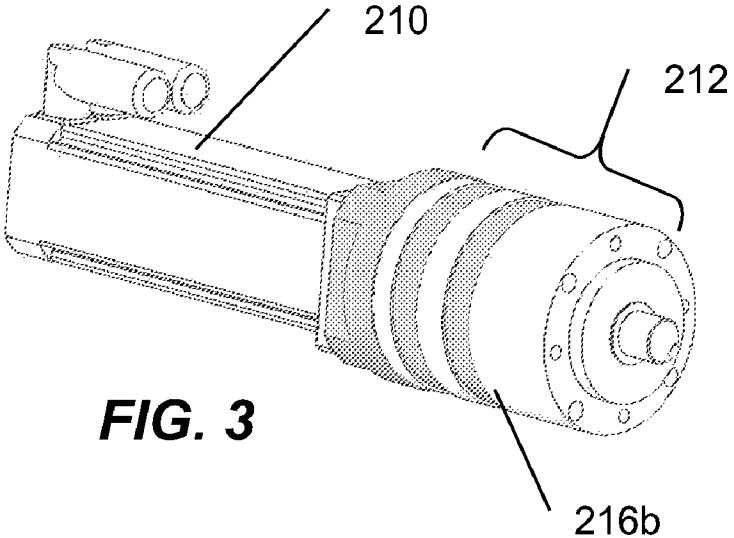
FIGS. 2-4 are illustrative representations of various alternative embodiments (e.g., differing load capacities) of an actuator drive assembly in accordance with various common design aspects of the embodiments disclosed.
Figure 2:
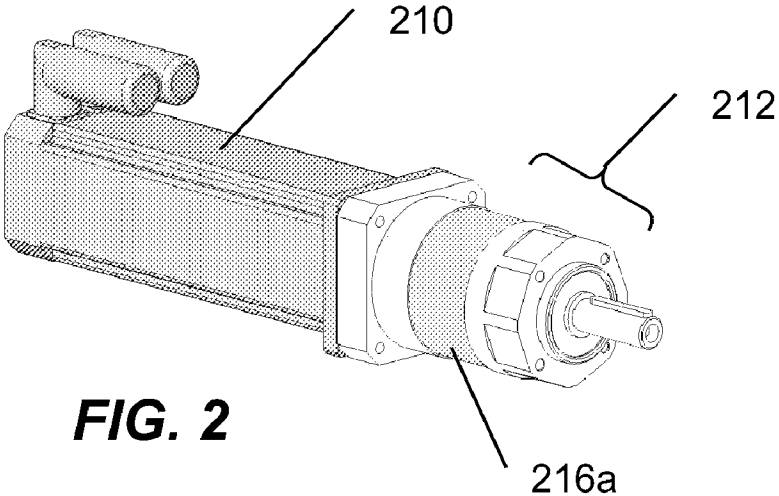
Figure 4:
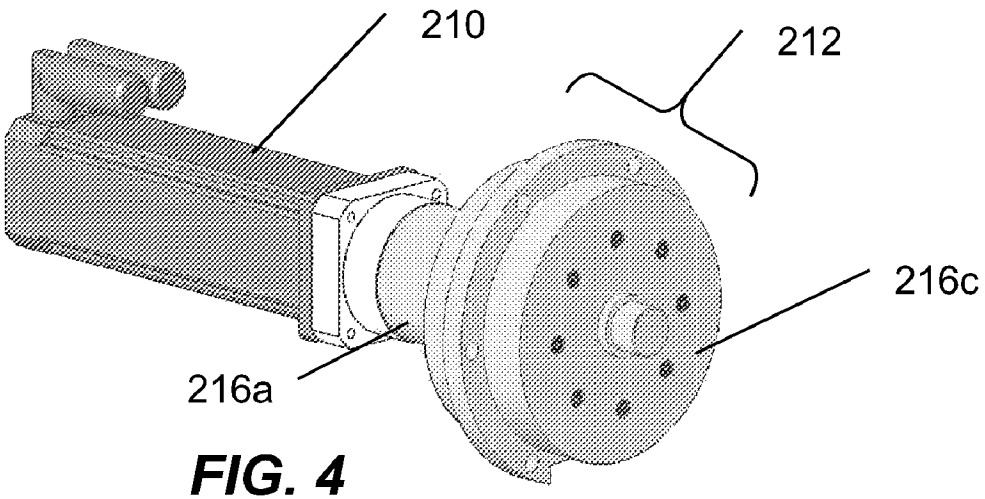
Figure 5:
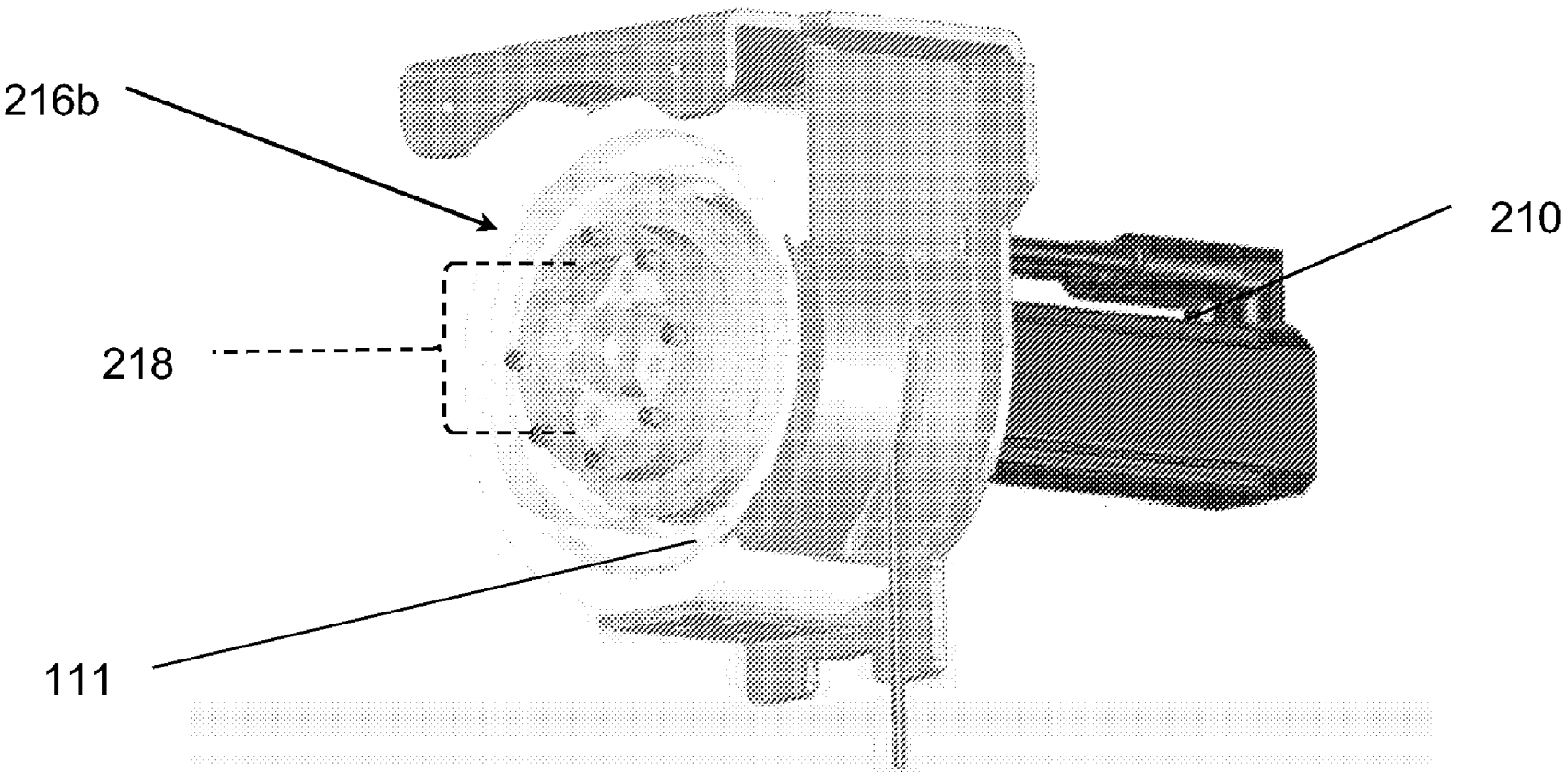
FIGS. 5 and 6 are exemplary representations of a planetary gear assembly illustrating alternative embodiments suitable for different load capacities.

One such example is depicted in FIGS. 2-4. In FIG. 2, for example, the motor 210 and an associated reducer 212 are employed, and either or both components may be used across several actuators having a range of lift capacities—for example as depicted in FIGS. 3 and 4. On a lower capacity unit a drum pulley integral adapter 216*a* is attached to the motor/reducer assembly. No additional reduction in used. Referring also to FIGS. 3 and 4, attached in place of the drum pulley integral adapter 216*a* is an alternative (FIG. 3) or an additional (FIG. 4) speed reduction means in the form of reducers 216*b* and 216*c*, respectively. The additional reducer 216*b* is designed/sized (e.g., internal planetary gear assembly 218; FIG. 5) so as to permit the motor 210 to lift an increased load weight. Referring also to FIG. 4, a reducer 216*c* is attached, wherein the additional reducer employed is designed/sized so as to permit the motor 210 to lift loads within another range. In this manner, the universal motor may be employed across a plurality of actuator load ranges, whereby the primary component being added/changed is the additional reducer(s).

As will be appreciated, the embodiments depicted utilize a stacked, building block gear reduction configuration, wherein the reducer assemblies 216*a*, 216*b* and 216*c* differ in load carrying capacity because the internal planetary gearing 218 has ratios that are varied between the different models. For the lowest lift capacity, a simple adapter is used in lieu of additional reduction. For the heaviest capacity, a second or "stacked" reducer is added, and the design of the second reducer is selected as a function of the capacity desired for the lift actuator. Also, as different or alternative reducer (and planetary) assemblies are employed, the controller is similarly altered or re-programmed so as to appropriately adjust the motor drive characteristics to accommodate the alternative reduction capabilities of the assemblies and direction of motor rotation.

Figure 6:
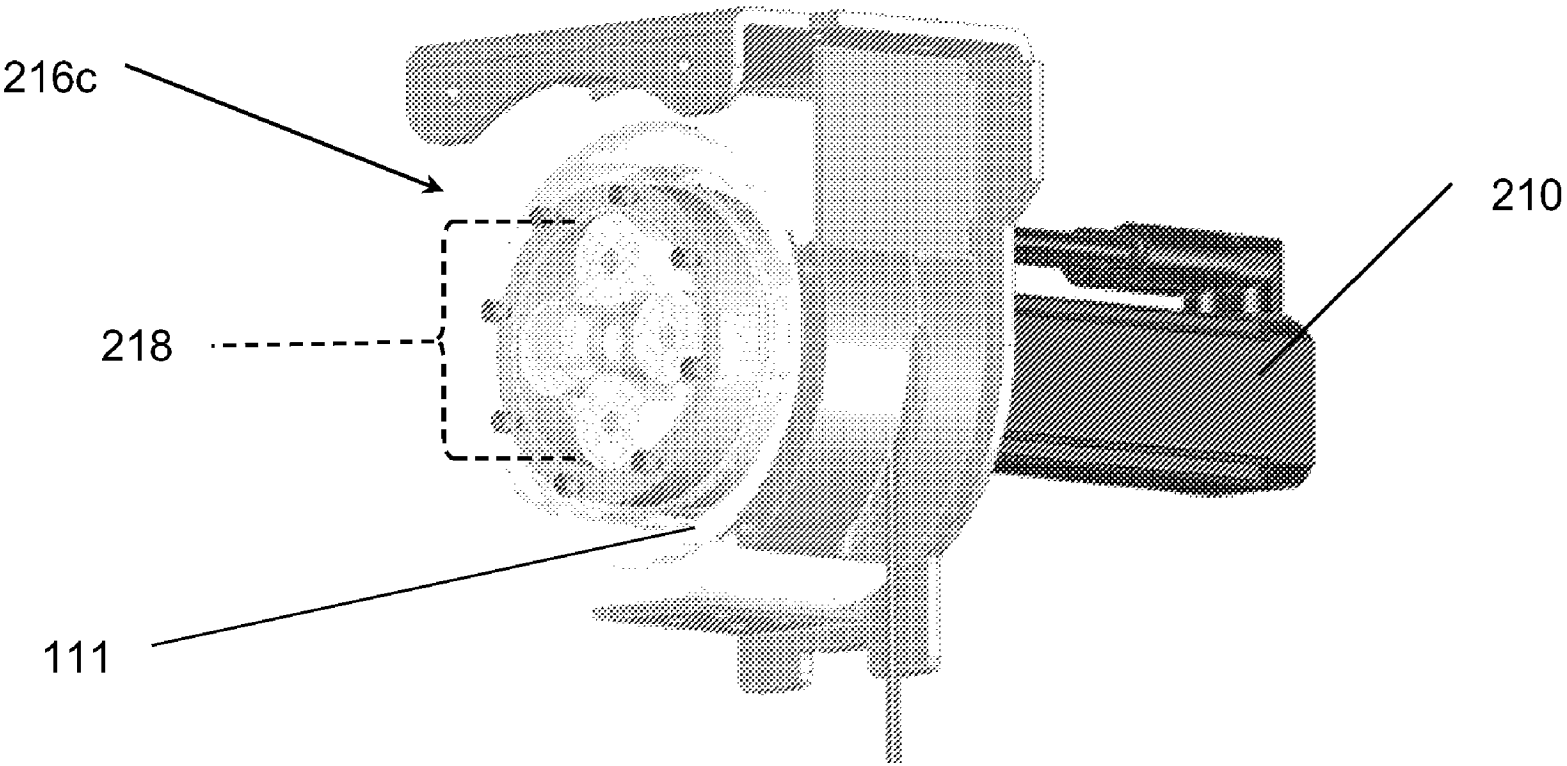
Figure 7B:
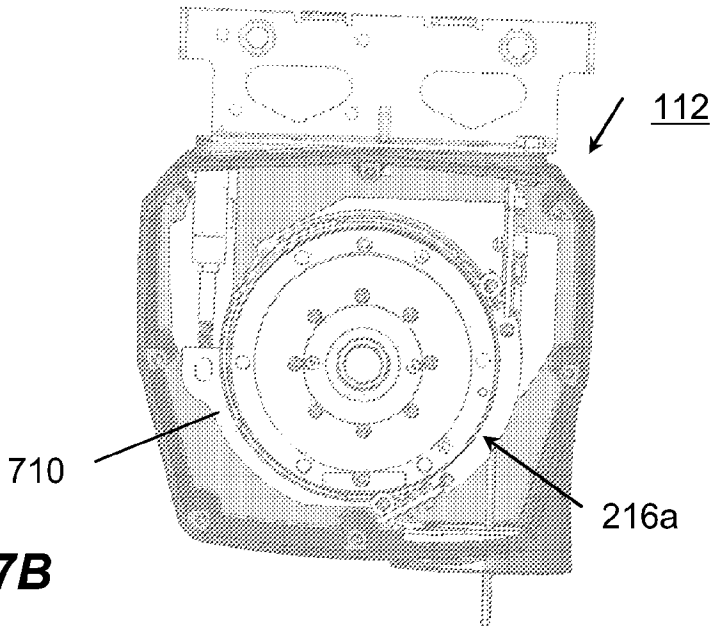
FIGS. 7A-B and 8-11 are illustrative representations of an improved load-sensing system employed as an aspect of the disclosed embodiments, wherein a load cell is used to sense the applied load via rotation of the drive assembly relative to the suspending structure.
Figure 7A:
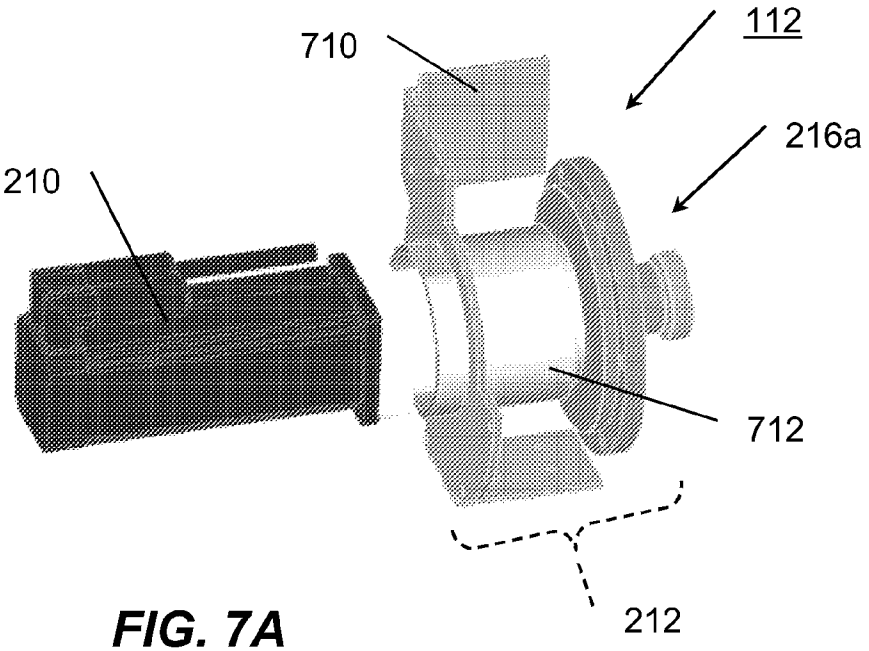

It will be appreciated that the actuator drive designs depicted in FIGS. 2-6 enable the mass production, yet customization, of the actuator unit for a specific application, and further facilitates efficient service as well as a more cost effective design in lower volumes. As is also depicted in FIGS. 5 and 6, several embodiments include the reduction gearing inside the drum pulley 111. The planetary gear reducers 218 are located inside the wire rope drum pulley 111, which saves space, weight and cost in contrast to conventional systems that place the reducer in-line with the drum. It also improves the balance of the actuator as it is suspended from an external structure such as a crane girder. With the reducer inside the drum the unit is compact, and the unit weight is reduced slightly due to less drum material. The cost of the reducer may also be reduced by producing the drum from conventional tubing versus a solid block of material which is machined. For example, in one embodiment, the drum may be manufactured from an aluminum alloy, or alternatively from a nylon or similar polymer compound providing suitable mechanical characteristics.

As will be appreciated by those knowledgeable in the field of lift systems, an important aspect of the various embodiments disclosed herein is the reduction in the weight of such systems. In order to practically increase the lifting capacity of a lift, one must also consider the impact of the increased capacity on the supporting structure for the lift (e.g., trusses, cantilever arms, trolleys, etc.). Thus, while it may be possible to provide increased lifting capacity, it may be necessary to decrease the weight of the lifting equipment itself in order to obtain an advantage from the increased capacity. For example, if lift capacity can be increased by 25 kg, in order to utilize the improved lift, it is necessary to assure that the supporting structure can handle the increased capacity, or the overall weight supported by the structure must be decreased. It is the latter point that is addressed by various aspects of the embodiments disclosed herein. Reduction of actuator weight permits greater use of the supporting structure's capacity for load weight. Moreover, decreased actuator weight makes it easier to move the lift around (less operator effort (manual) or smaller motors (trolley)).

Turning next to FIGS. 7A-C and 8 through 10, depicted therein are further components of an embodiment of the actuator 112 in which the load supported by the actuator may be directly sensed using a compressive load cell. Actuator 112 further includes an arm 710 or similar structure and sleeve 712 which are operatively connected to one another and to the drum pulley 111. In one embodiment the arm 710 is attached to the sleeve so as to provide surfaces to actuate the load sensing and slack sensing features disclosed herein, and to provide for positive rotational stop during a slack condition. As illustrated, for example in FIG. 9, the sleeve 712 further supports the additional reduction and the drum pulley 111 having a wire rope or cable 930 wound thereon, with one end attached to the drum pulley 111.

Figure 8:
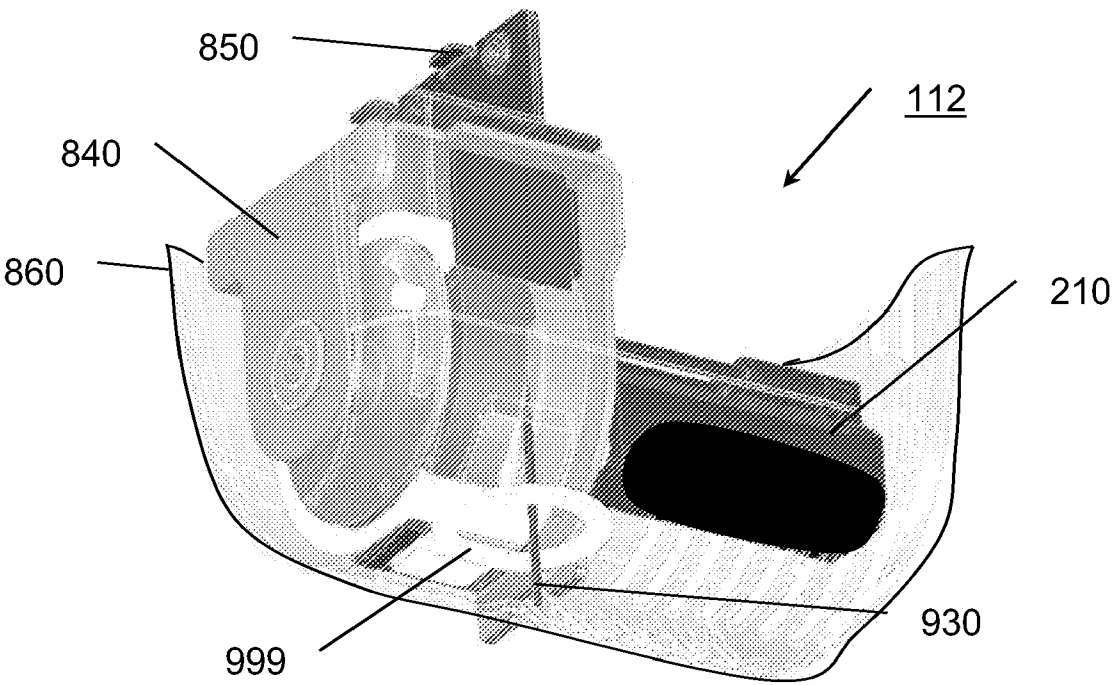
Figure 7C:
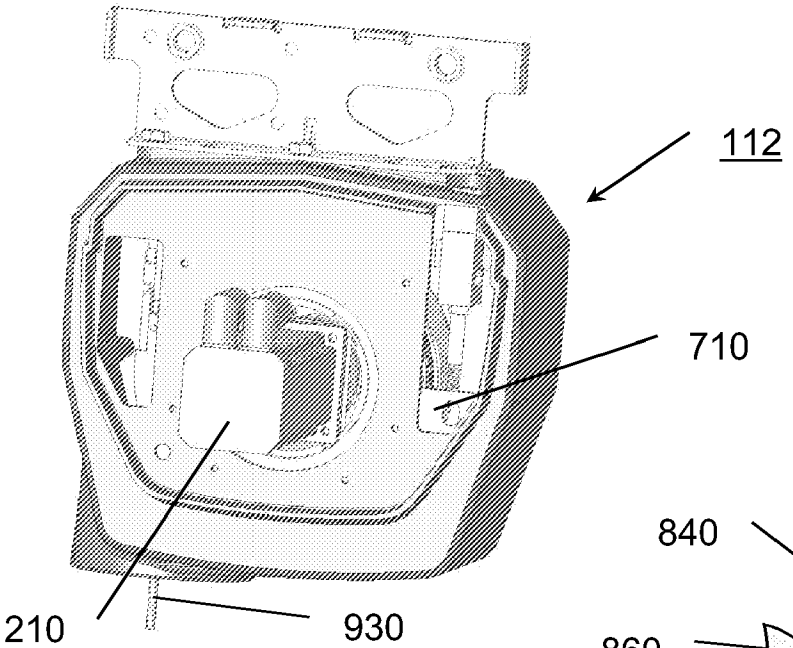
Figure 9:
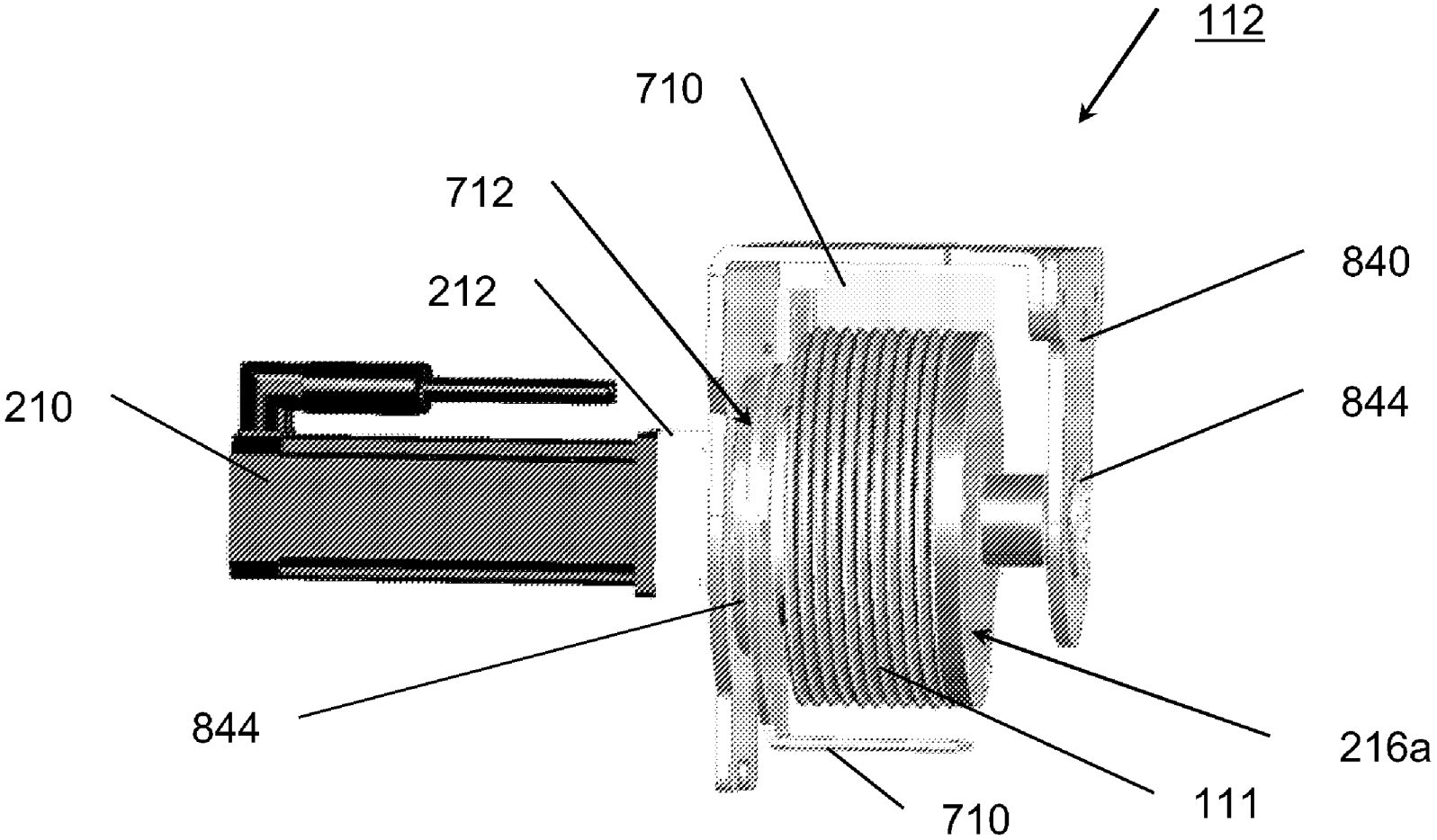

In one embodiment, the actuator 112 also utilizes an ultra-high molecular weight (UHMW) polymer wear ring 999 (the doughnut-shaped aperture at the bottom of the actuator thru which the wire rope 930 passes). Use of the wear ring results in a higher durability when compared to conventional actuators. In another embodiment, it will be appreciated that alternative designs of the actuator may alter the manner in which the supporting brackets (e.g. arm 710) are connected to the actuator drive components and/or the covers and housings as depicted in FIG. 8. For example, the design depicted in FIG. 10 employs a slightly different arm and related support structure in the actuator.

The actuator 112 further includes the center casting 840, whereby the drum or additional reduction of the actuator drive assembly is supported therein by bearings 844, but where the drive assembly, including drum pulley 111, sleeve 712, coil cord support and arm 710, is capable of rotational, albeit constrained, motion relative to the center casting as will be appreciated as required in order to employ the load cell to sense the load at the actuator (rotation of the actuator drive components). Actuator 112 further includes, as depicted in FIG. 8, a support member 850 connected to center casting 840, to suspend the actuator from its supporting structure—such as a trolley or arm (not shown)—as well as a case or housing 860 (shown as cutaway in FIG. 8) to enclose the operational components of the actuator. One embodiment of a housing suitable for the depicted actuator is found, for example, in U.S. Design patent application Ser. No. 29/256,812, previously incorporated by reference herein.

It will be appreciated that in addition to the molded covers, it may be possible to further reduce the cost of the actuator 112 by employing less expensive covers. For example, covers or cover components made of formed sheet metal or plastics and stock material shapes may result in significant reductions. Moreover, current sheet forming techniques permit the formation of somewhat complex shapes similar to those partially depicted in FIG. 8 and in the above-identified design application. In one embodiment employing formed metal covers, the gates or apertures remain the same, but the remainder of the cover may be altered in design so as to accommodate alternative materials and forming techniques.

In addition to the improved, universal drive design, the drive and control electronics, for example the ACOPOS Servo Drive , produced by B&R Automation under manufacturer's part no. 8V1016.50-2, further provides improved input/output capability and enables further design improvements characterized as plug and play components. The plug and play characteristics of the various components—actuators, handles, etc. permit the lift controller (not shown) to recognize what type of handle has been attached to the lift, and to adjust any programmatic controls or I/O so that the detected component works properly with that handle. The plug and play design overcomes difficulties observed in conventional lift systems when mechanical and electrical alterations must be made when changing from one handle type or actuator type to another, thereby avoiding time consuming and costly modifications, and permitting the possibility of field alterations and upgrades.

Another feature enabled by an improved controller associated with actuator 112 is remote diagnostic capability. In a remote diagnostic embodiment, the controller includes communication circuitry such that information may be exchanged between the actuator controller and another computing device (e.g., a workstation, crane controller, etc.) via a network connection (LAN/WAN/Internet). In accordance with an aspect of the present invention, the remote diagnostic capability enables remote configuration as well as troubleshooting of a lift device such as an actuator.

For example, when a customer in Detroit has a problem with a particular actuator, it would be possible to access the controller of that actuator (with a certain network IP address or similar identifier) from a remote location, or at least to receive data from the controller at the remote location, via Ethernet, a modem and/or the Internet, and to check and change settings as well as address any performance issues. The remote diagnostic and service capability is believed to significantly reduce the cost of maintaining and servicing the systems as it is not presently possible to accomplish lift service or address performance problems without typically having a technician travel to the work site or have the actuator shipped back for service. This will greatly reduce the downtime of the unit. It is anticipated that the controller will utilize a standard communication protocol such as CANbus as well as other well-known digital communication technologies and protocols, and will at least be able to execute and log rudimentary diagnostic functionality including transmission of log information and performance records, among others.

As described above, the design of the actuator 112 is such that the drive assembly is able to rotate relative to the center casting 840. Such a design facilitates the use of a compressive load cell 1170 as depicted in more detail in FIGS. 10 and 11. In a conventional load-balancing lift, the load cell is typically embedded within or associated with the control pendant or end-effector, where the load is applied or attached. Such systems, however, require the use of more complex load sensors (tensile and compressive sensing), and further require the timely and accurate transmission of signals back to the actuator controller in order to control the load. They also require a more complex and costly interlocking load cell design to provide reasonable safety should the pendant-based load cell fail. Mounting compressive load cell 1170 on the drum center casting 840, permits sensing of a rotational force applied to arm 710, the rotational force being created by a load suspended on the free end of cable 930. Locating the load cell in the actuator enclosure, adjacent to the control systems also provides for a shorter transmission path and improved signal quality received by the controller 150 (FIG. 1).

Figure 11:
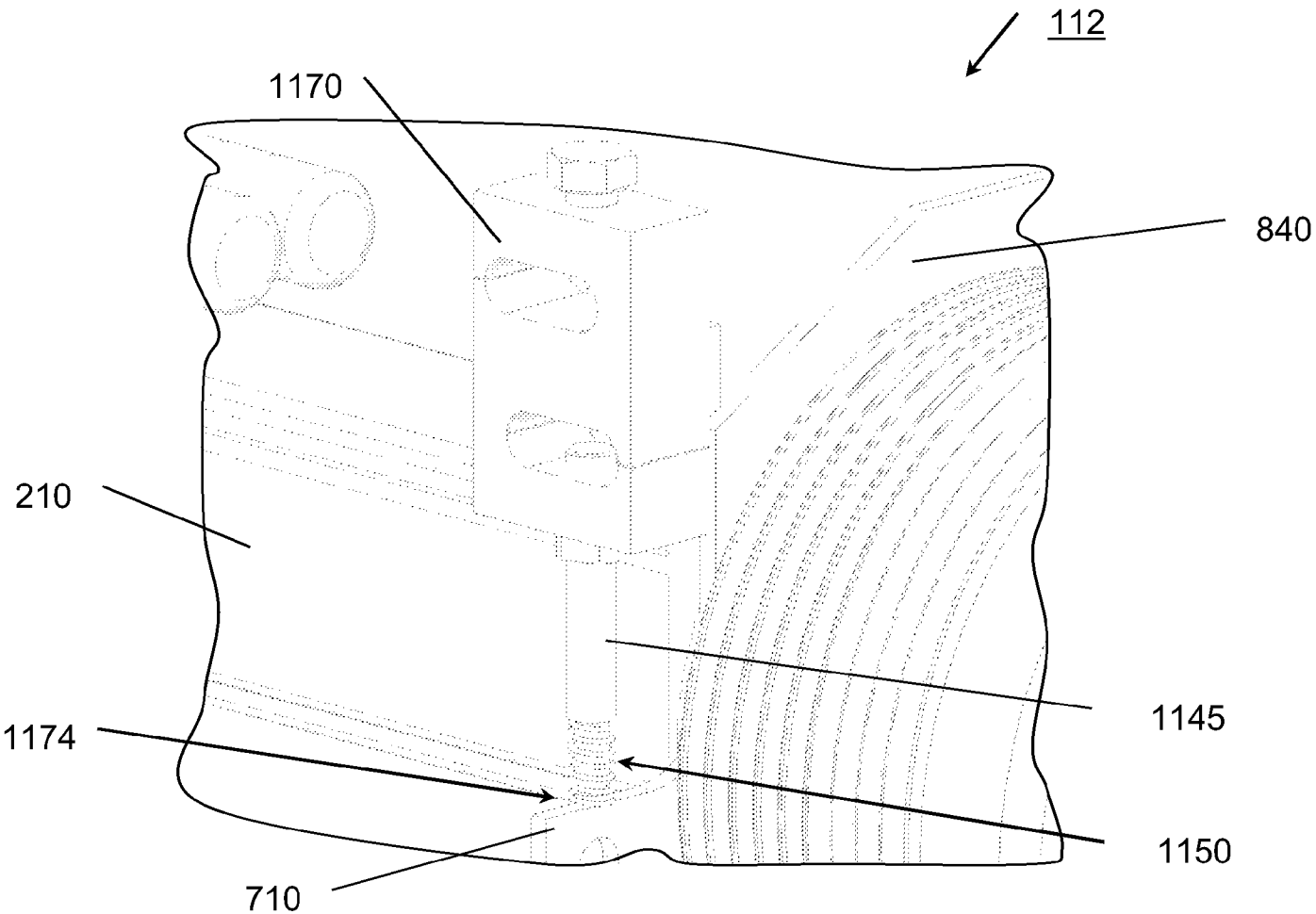

Taking the load cell out of the load path also improves the safety of lift devices because should the load cell fail, the load will not necessarily fall. Hence, the design depicted in FIGS. 10 and 11, enables sensing of the load at a location adjacent to the drive assembly, and without making the load cell a "link" in the lift system. In the drive assembly (e.g., drum pulley 111, reducing gearbox 212, adapter/additional reduction (216*a, b* or *c*) and motor 210) the components of the assembly rotate axially on rolling bearings 844. An actuation surface 1174 is associated with arm 710, and arm 710 is in turn assembled to sleeve 712 that is bolted to a mounting face of the gear reducer 212. The compression style load cell 1170 is rigidly attached to the center casting 840 of the hoist, and is situated to sense the force applied by the actuation surface 1174. As the operator manually applies force to a suspended load, the drive mechanism rotates in the direction of arrow 1178 and changes the force applied to the load cell. The heavier the force, the greater the compression sensed by the load cell, and visa versa. As depicted in FIG. 11, the force sensor may include a small biasing spring 1150 at the end of load cell shaft 1145 that "balances" the dead weight of the cable and/or pendant away from the load cell, and as described below is important for slack-sensing as well. In an alternative embodiment, the present invention contemplates the derivation of the load applied to the cable, or pendant suspended therefrom, by monitoring the motor current through the controller and associated software.

A further improvement to the lift actuator may include load cell signal conditioning. In addition to processing the load cell signal in order to make the signal useful for the present application, it is further contemplated that a single conditioning circuit may be employed for the load cell signal, wherein up to three or more load cells may be employed (e.g., three different load ranges) and a common or universal conditioning circuit may be used. Again the alternative to the universal signal conditioning approach would be to have separate circuits to handle the different load cells and the output signals they generate in response to the load suspended from or applied to the cable.

Figure 12B:
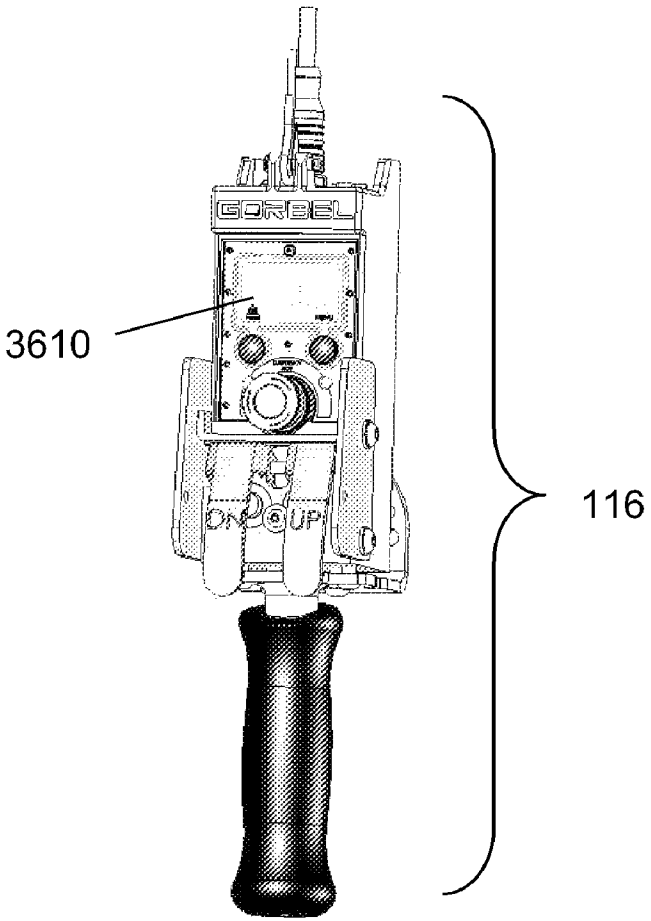
FIGS. 12A and 12B are alternative embodiments of operator interface devices employed in accordance with the disclosed invention.
Figure 12A:
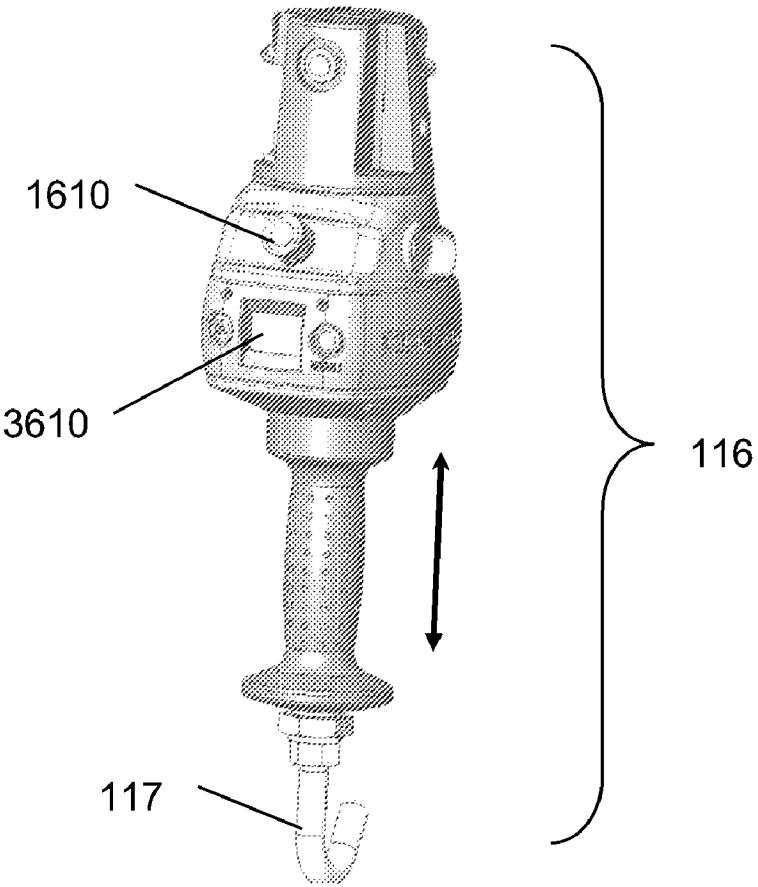

Referring next to FIGS. 12A-B and 13A-C and 14, depicted in FIG. 12A is an improved electromechanical mechanism for determining operator intent in the control pendant 116. As an alternative, a pendant such as that depicted in FIG. 12B may be employed to control the present invention. Aspects of such a pendant are disclosed in published US Application 2005/0207872A1, filed Mar. 21, 2005 by M. Taylor et al. (U.S. Ser. No. 11/085,764), which is hereby incorporated by reference in its entirety. Both devices may employ various signaling devices (visual, audible, vibrational), and may include a liquid crystal or similar display means 3610 for indicating a current operating state or other information for the operator.

Figure 13A:
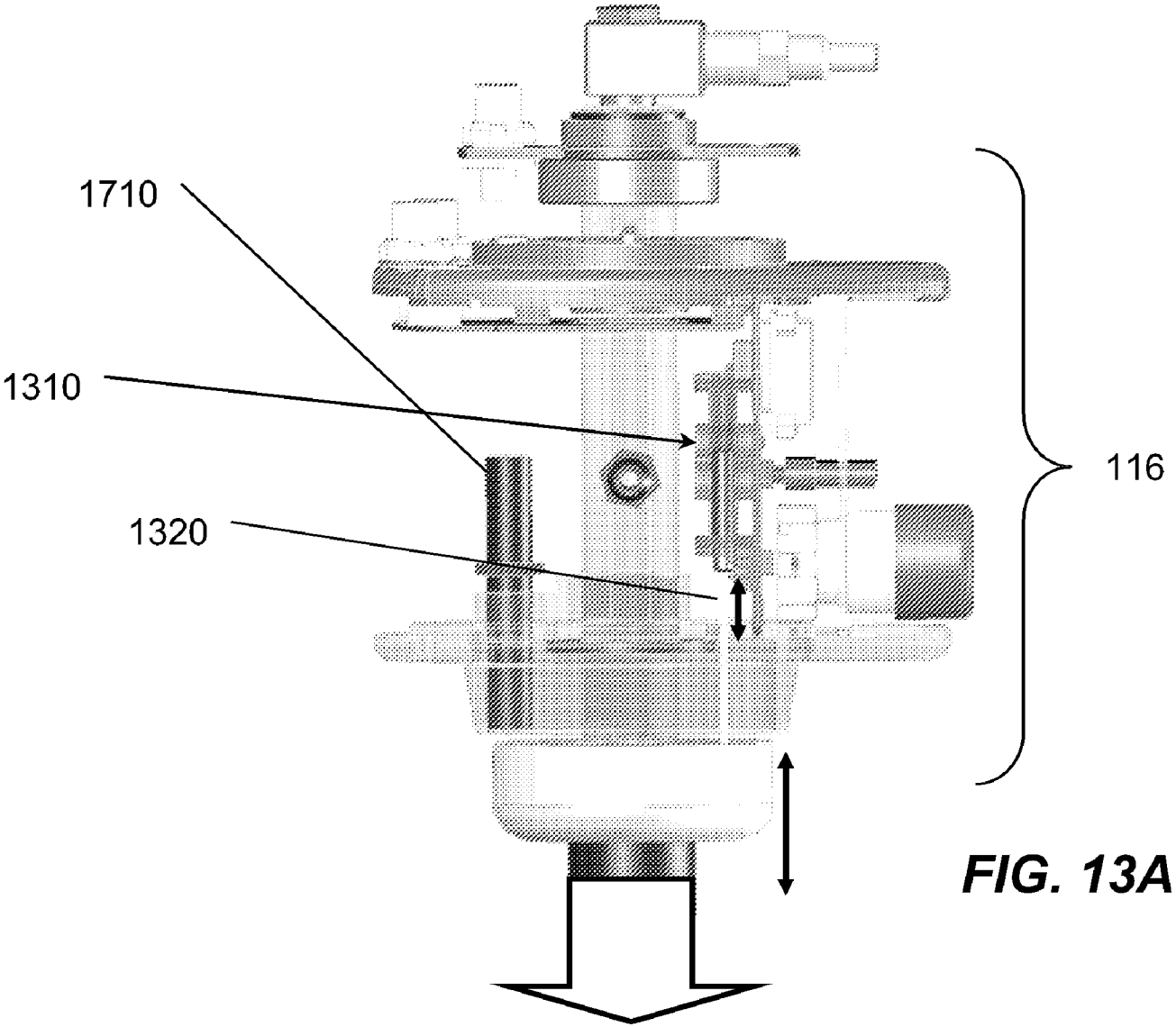
FIGS. 13A-13C are illustrative examples of the components and operation (FIGS. 13A, 13B) of the operator interface device depicted in FIG. 12A.
Figure 13B:
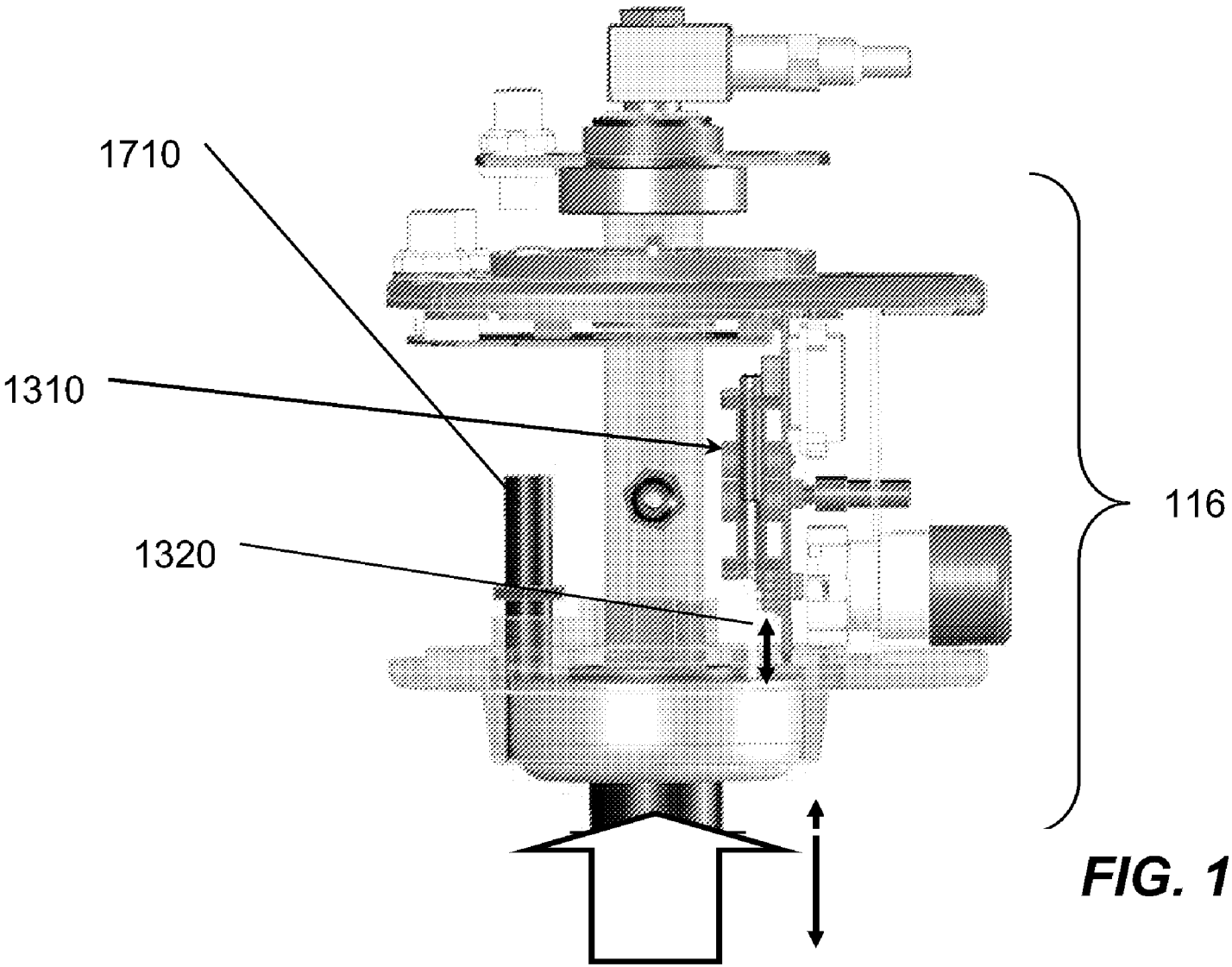
Figure 13C:
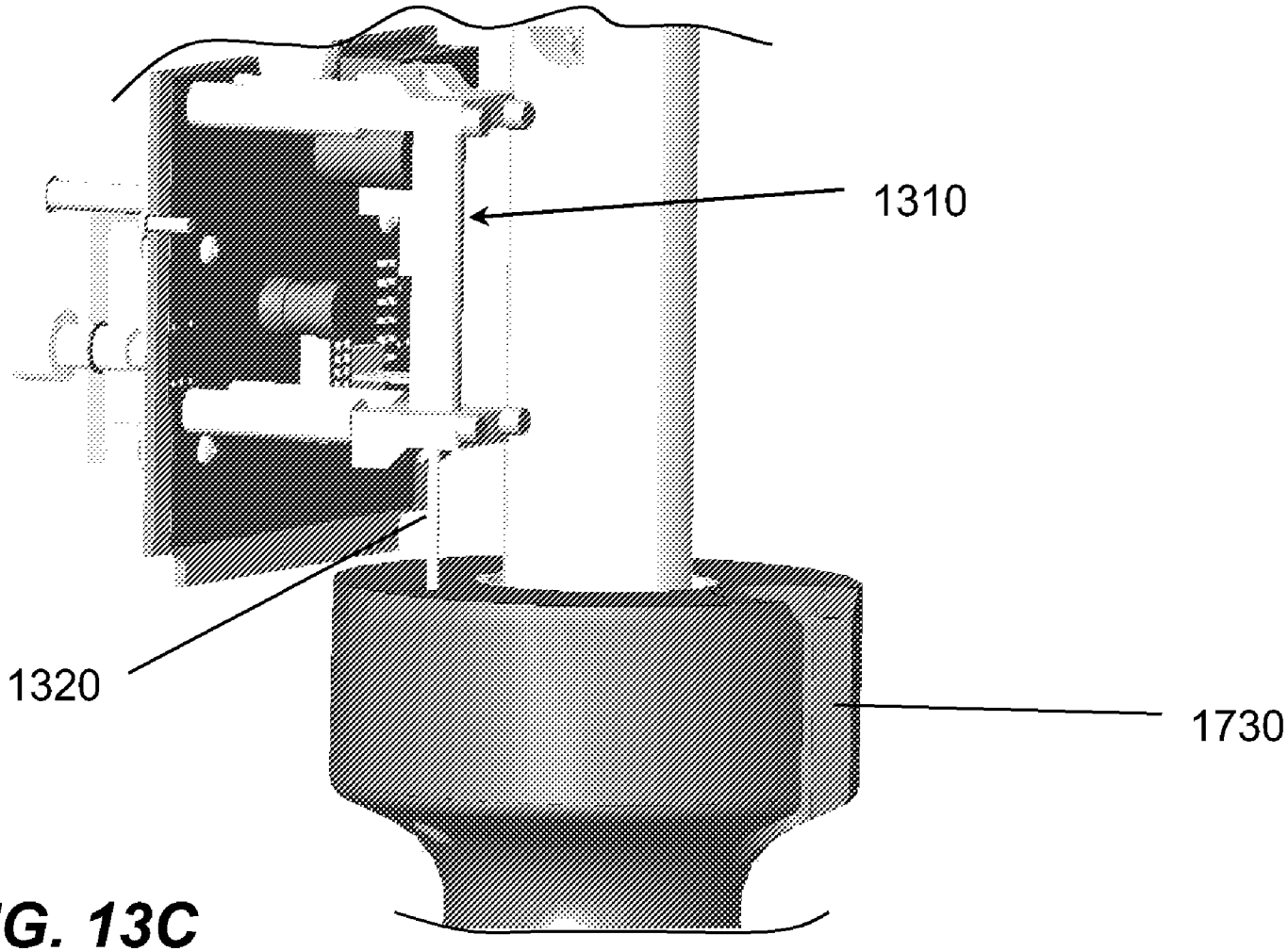

In the embodiment of FIG. 12A, as further illustrated in FIGS. 13A-C the sensing mechanism employs a coil arrangement 1310, as compared to the traditional linear variable-displacement transducer (LVDT). In the embodiment, the coil is used to sense a core, consisting of a metallic rod or similar component, therein and to sense operator intent (lifting or lowering). A further modification in the depicted embodiment is the use of flexible filament 1320 for attaching the core to the sliding portion of the handle, operator grip 1716. The use of a custom coil arrangement is believed to be a less expensive alternative to the commercially available LVDT. Moreover, the use of a flexible filament (e.g., nylon or similar plastic or flexible material) to connect the core to the handle prevents shearing the core off under use situations where the handle is over-torqued or rotated under load as well as preventing drag on the system if not perfectly aligned. It is also possible to employ LVDT or magnetic sensing devices to determine the downward or upward operator inputs illustrated by FIGS. 13A and 13B, respectively. The embodiments depicted in FIGS. 13A and B illustrate the respective motion of the handle (lower large arrow), relative to the coil.

Alternative means for sensing operator input via the handle are described, for example, in U.S. Pat. No. 6,386,513 to Kazerooni for a "HUMAN POWER AMPLIFIER FOR LIFTING LOAD INCLUDING APPARATUS FOR PREVENTING SLACK IN LIFTING CABLE," issued May 14, 2002, and WO2005092054, for an "ELECTRONIC LIFT INTERFACE USING LINEAR VARIABLE DIFFERENTIAL TRANSDUCERS," published Oct. 16, 2005, both of which are hereby incorporated by reference in their entirety. In one embodiment, the control pendant may be similar to that depicted, for example, in co-pending U.S. Design application Ser. No. 29/256,811, previously incorporated by reference.

Figure 14:
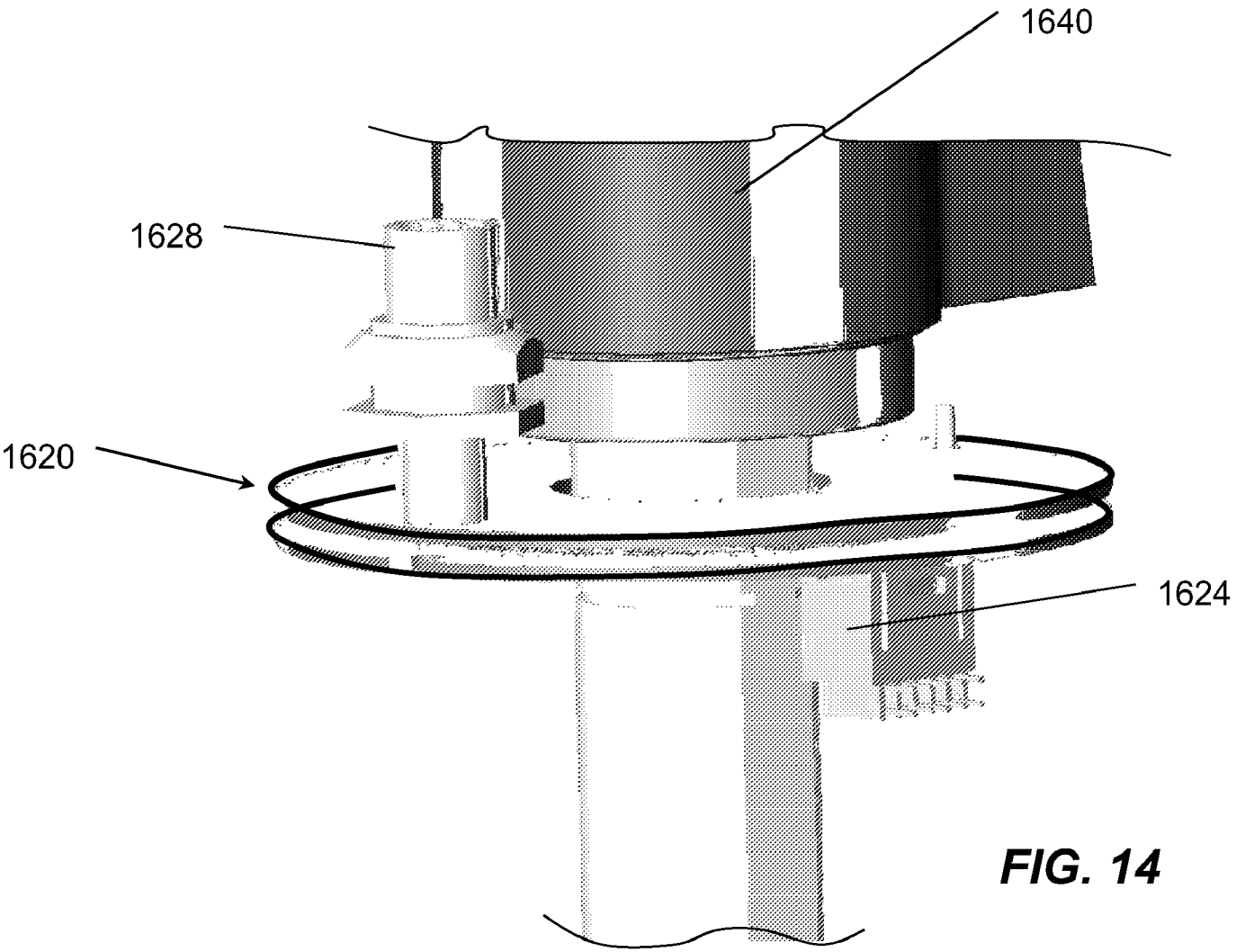
FIG. 14 is an illustration of a slip-ring assembly suitable for the conduction of electrical signals as well as air (fluid) to the operator interface device of FIG. 12A.

Another aspect of the improved control pendant is depicted in FIG. 14, where a slip ring has been designed to permit the accurate and reliable transmission of the output from the coil sensor 1320 as well as the power switch 1610 or related electrical signals present in electrical connector 1624, up to the actuator 112 via the control coil cord cable that may be plugged into connector 1628. The design utilizes a pancake-style slip ring assembly 1620, in the control handle, to allow 360-degree continuous rotation, independent of the wire rope and controls coil cord cable. The custom slip ring passes the electrical signals from the rotating handle up to the control coil cord cable. The custom slip ring assembly is also specifically designed to allow for air (pneumatic and/or vacuum) or other pressurized fluid access through its center via a swivel inlet 1640. This permits the operator to run air power to the end tooling, and still rotate 360 degrees continuously.

It will be appreciated that slip ring contacts are known, but it is believed that the design of an integrated electrical and air conduit that facilitates unrestricted rotation is an improved aspect of pendant design not previously employed in lift technology. The air conduit preferably enables the transmission of a pressurized fluid (e.g., pneumatic, vacuum, hydraulic) to a tool associated with the pendant. The improved design further controls or reduces acceptable "headroom" in the pendant at a reasonable cost.

Referring to FIGS. 13A-C, there is illustrated a further aspect of the pendant design, wherein the presence of the operator (hand on handle) is sensed using an inductive, or preferably a reflective photoelectric sensor 1710. In one embodiment, sensor 1710 is a tubular photoelectric sensor (metal, 12 mm, PNP) and an indicator light on the sensor switches when it detects the reflected light to indicate an operator's hand is present. It will be appreciated that various alternative types of dead-man switches are known, however, many of these require a firm grip or prolonged grasping of the operator grip 1716, which may lead to operator fatigue as well as confusion. The design depicted in FIGS. 13A-C illustrates a photoelectric sensor as a means of sensing the hoist operator's hand when engaged with the control handle, requiring no interpretation on the user's part, avoiding the tendency for users to use the switch as a means to turn the unit on and off. When engaged, the sensor sends a signal back to the controller that then allows the hoist to be operated in the up and down direction. Alternative sensors or switches for detecting the operator's hand include a mechanical style roller switch similar to known designs, a touch sensor, an inductive optical sensor, and a membrane sensor. As will be appreciated, locating the sensor within the body of the pendant is preferable to avoid damage or tampering, however, the pendant handle must then include an aperture 1730 through which the presence of the operator's hand can be sensed.

Figures 15A, 15B:
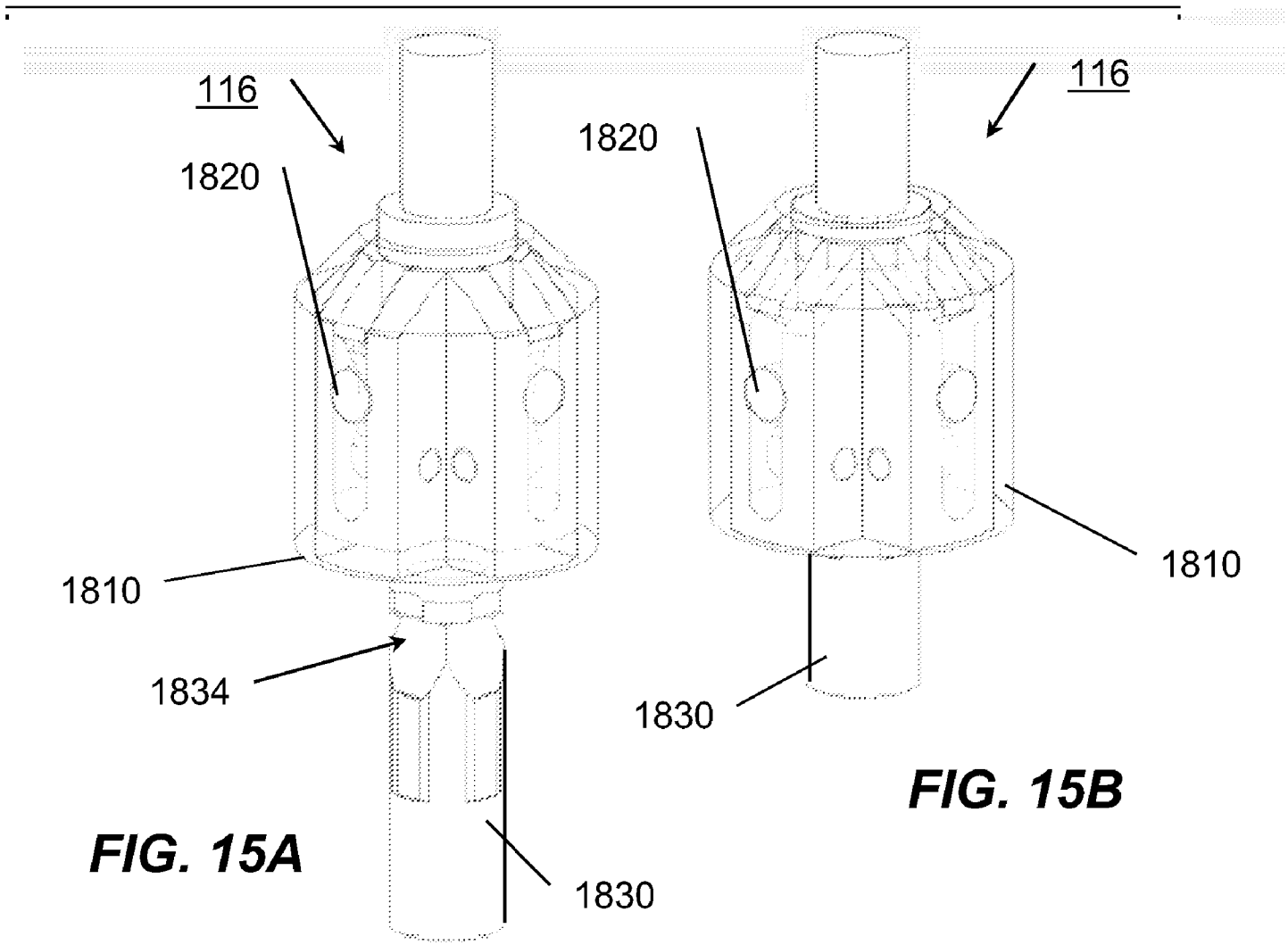
FIGS. 15A-B and 16 are detailed representations of alternative embodiments of the operator interface devices of FIGS. 12A-B.

In various uses of an actuator and control pendant, it is sometimes necessary to change or alter the load interface in the field. For example, instead of a hook, the load may need to be lifted using a threaded connector or the like. Referring to FIGS. 15A-B, the design depicted therein contemplates a quick-disconnect adapter on the bottom of the pendant or end-effector 116, wherein an operator may quickly change out end tooling by sliding down a collar 1810 that retracts locking pins 1820, and allows the tool mounting shank 1830 to release. Another tool can then be quickly and easily attached by sliding its mounting shank up into the mounting hole, retracting the locking pins as it passes and then securely locking into place when the pins engage the grooves 1834 on the shank. No tools are required for end tooling changes.

Figure 16:
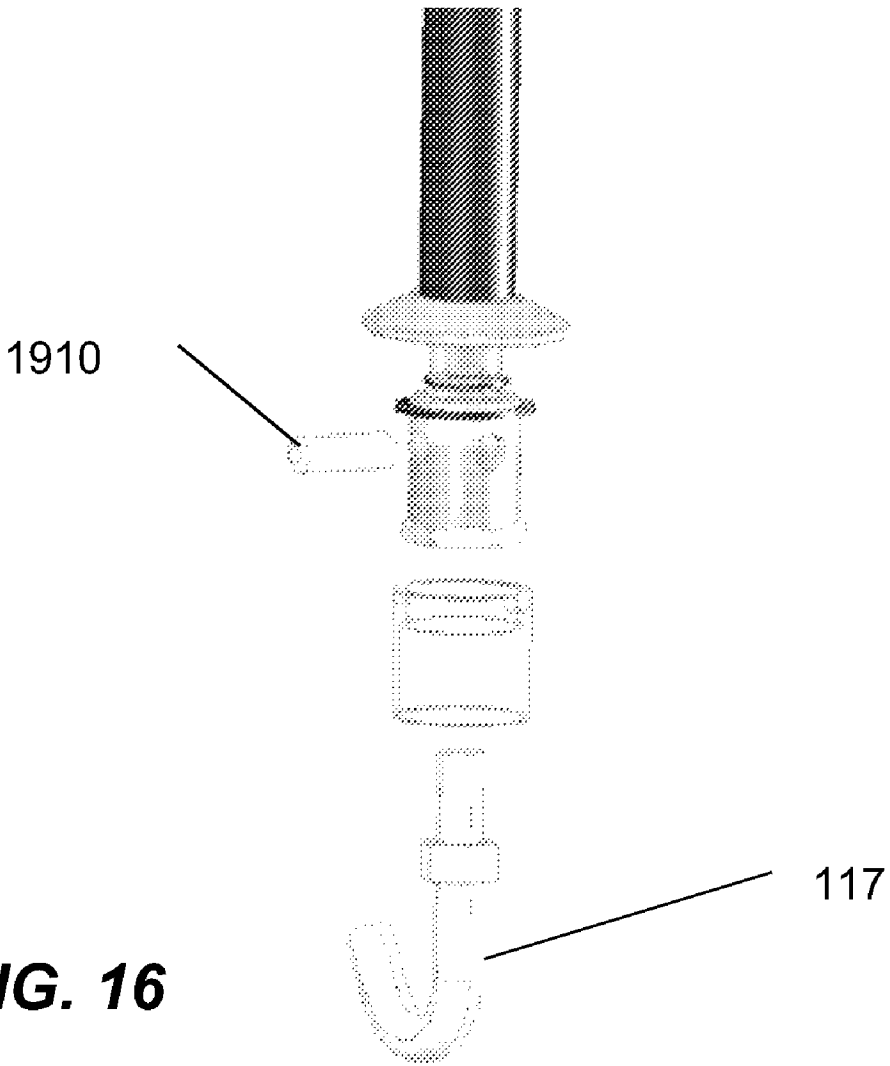

It will be appreciated by those familiar with lift systems that the known threaded coupling technique may be employed, or that alternatives requiring the operator to physically remove a pin 1910 (FIG. 16) in order to release the tooling may be included within the scope of the various embodiments described herein.

Referring next to FIGS. 17-21, there are depicted aspects of an embodiment of the present invention incorporating an improved cable slack-sensing capability. In particular, as alluded to above relative to the improved load-sensing, the actuator embodiment depicted in FIGS. 17-21 senses cable slack using the rotation of the drum, gear reduction and motor (drive assembly) as well (albeit in the opposite rotational direction). In this design, the main drive assembly (drum pulley 111, gearbox (not shown) and motor 210) rotate axially on rolling bearings 844. An actuation plate or arm 710 is assembled to a sleeve that was bolted to the mounting face of the primary gearbox, and also rotates along with the drive assembly. When the operator removes all weight, excluding the control handle and any applicable tooling from the wire rope 930, slack is induced. When slack is induced, the drive assembly rotates in a counter-clockwise direction (arrow 2020), aided by the use of an compression spring 1150 (FIG. 11). Provisions for adjustment of the spring force will be required to facilitate variations in customer applied tooling. The compression spring 1150 is mounted between the load cell 1170 and surface 1174 of the actuation plate and is coaxial on a load pin or shaft installed in the load cell. When the drive assembly rotates under unloaded or slack conditions, a micro switch 2030, mounted to the main support frame of the hoist senses the presence of the actuation plate (FIG. 24) by contact with the actuation plate at 2034. When the micro switch is activated, it sends a signal to the controller (not shown) whereby the software will only allow the hoist to move in the upward direction. For the safety of the user, once slack is sensed, the controller will not allow the hoist to feed out any additional wire rope in the downward direction.

As will be appreciated, the use of the rotating drive assembly for the purposes of load and slack sensing permits the load sensing device to "see" any torque loading and thereby be able to sense all the load that both the wire rope, and the coil cord/air hose would see. In other words, the load sensor will have a compressive load applied to it that is the direct result of the weight of the load. Also as the load is raised or lowered, the cumulative load remains the same, even though the relative portions of the load carried by the coil cord, air hose, and wire rope can vary. Since the entire wire rope and coil cord assembly are supported from the rotational drive assembly, the load cell senses their entire weight at all times, thus variations in load height does not affect load sensing or float mode operation. Any potentially detrimental affects, for example on float mode, of the spring force and weight of the coil cord are negated by this mounting configuration.

In alternative embodiment, it may be possible to sense slack utilizing software to monitor the current of the motor to determine a slack condition. Although possible, it remains a concern that such a method may prove to be unreliable. It is also contemplated that instead of the mechanical, contacting switch (roller switch or the like) a non-contacting proximity sensor 2040 may be employed to sense the rotation of the plate 710. Such an embodiment is depicted, for example, in FIGS. 20 and 21, where sensor 2040 is employed to sense the rotation of plate 710 to determine the slack condition.

Attention is now turned to several additional aspects of the improved actuator 112, which includes a drum pulley and wire rope (cable) guide arrangement. Referring to FIGS. 22 through 29, the improved design utilizes a two-piece assembly 2610 (2610*a*, 2610*b*, etc.) that clamps or assembles around the wire rope or other lifting medium, and slides back and forth on rails provided by the drum cover 998 (FIG. 25). The sliding motion for assembly 2610 is induced by threads 2620 contained on one half of the assembly, 2610*a* that runs in the open grooves 2622 of the wire rope drum pulley 111.

Figure 24:
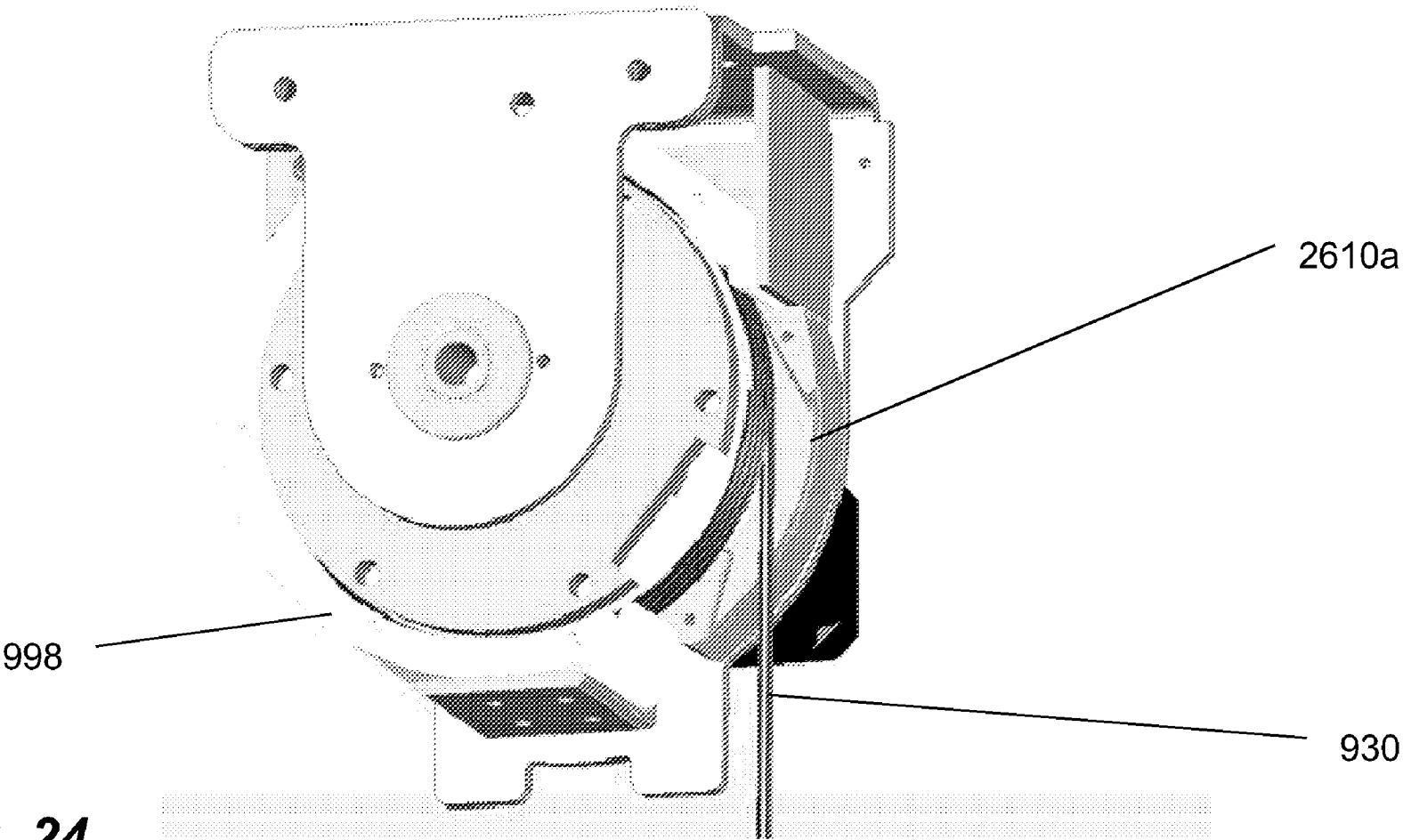
Figure 25:
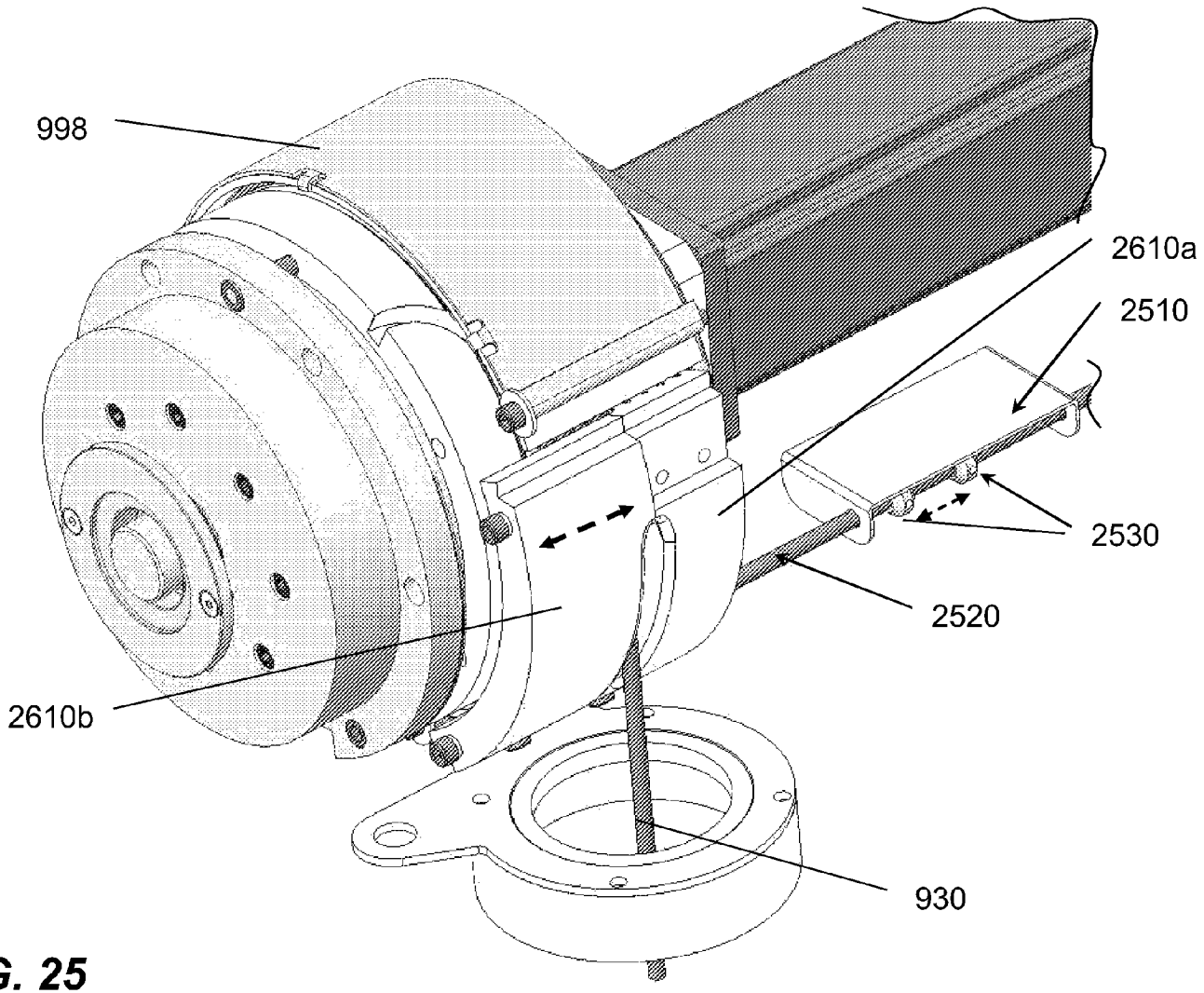
FIGS. 25 and 26 illustrate an embodiment wherein the cable gate components of FIGS. 22-23 are used to sense cable travel limits.

Assembly 2610, when assembled about the rope 930, provides a sliding gate or aperture through which the wire rope 930 departs from the drum as depicted in FIG. 24. Such a device, in addition to the function of protecting the cable and the drum, also prevents any side wear on the drum grooves and keeps the wire rope tightly constrained on the drum pulley, thus avoiding the creation of unwanted slack. In other words, the wire rope's side forces are taken by the gate and the cable is not prone to wearing the drum surface because the alignment at entrance to the drum grooves is nearly perfect in all cases. The large bearing area of the threads on the gate 2610*a* provides great lateral force, and distributes this force over many grooves in the drum, since any lateral force is only likely to occur when the wire rope is nearly fully out, and the engagement of the gate and the grooves of the drum is at its maximum number of threads on the gate. Having this half of the gate permanently attached to the drum allows it to maintain registration when replacing the wire rope.

Another feature of this embodiment is depicted specifically in FIGS. 24-29, where the sliding gate 2610 allows the gate itself to be employed as an indicator of the upper and lower travel limits for the cable. As depicted by the dashed-line arrows in FIGS. 25 through 28, the gate slides back and forth driven by the drum pulley rotation as the wire rope is being wound and unwound therefrom. The addition of the limit switches 2510 depicted in FIGS. 25 and 26, for example, permit the motion of the gate 2610, transmitted through a rod 2520, or similar member, to be used to identify travel limits. As described below, the design allows the setting of limit switches to be unaffected by changes to the system, replacement of the wire rope, etc. In fact, only the side of the gate nearest the anchored end of the wire rope, 2610*b*, has to be removed to change the rope, even though the limit switch for maximum wire rope out has to be bypassed for the reloading operation. It will be appreciated that a more conventional ball screw drive mechanism, to move the wire rope drum pulley back and forth may be employed, or that a mechanism that gears or operatively drives an idler pulley via a single groove on the drum pulley may be used as is the case in many current Gorbel actuators.

Figure 26:
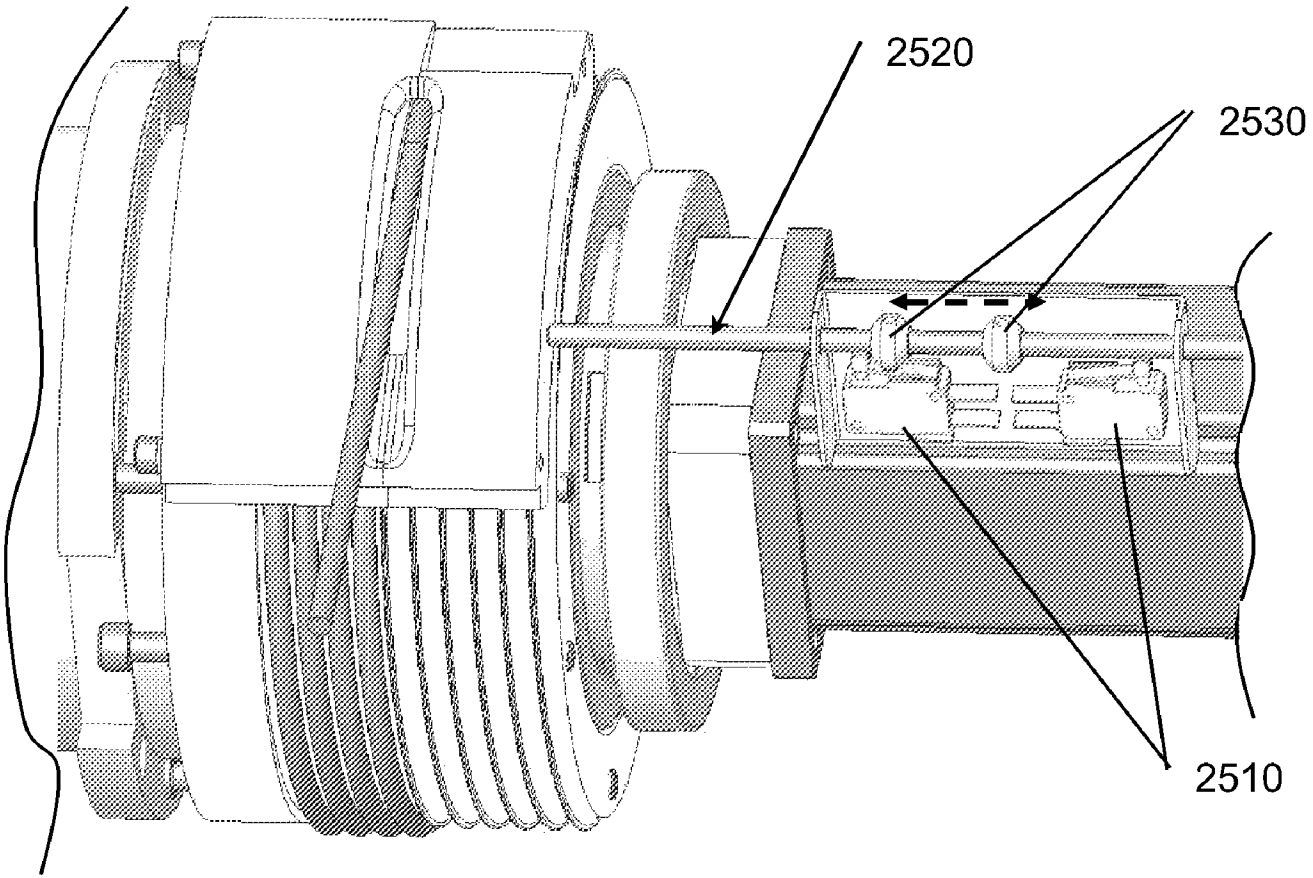

Referring specifically to FIGS. 25 and 26, depicted therein is a limit sensing system employing micro switches 2510 as noted briefly above. Depicted is an embodiment that consists of a rod 2520 which is moved back and forth as a result of movement of the threaded gate (gate 2610*a*). On the rod are contained two adjustable cylinders 2530 which can moved to the desired location and then fixed in placed, e.g., with a locking nut or similar means). These cylinders contact the micro switches 2510 when the gate is in its upper and lower limit locations. As the wire rope guide or gate mechanism slides back and forth, and the cylinders trigger the sensor 2510, a signal is sent to the controls to activate either the upper or lower travel limit of the unit. When a travel limit is triggered, the software will then only allow the hoist to operate in the direction opposite of the triggered target (i.e. if the upper limit is triggered, the hoist will only operate in the down direction). The limits may be adjusted by moving the cylinders.

Figure 27:
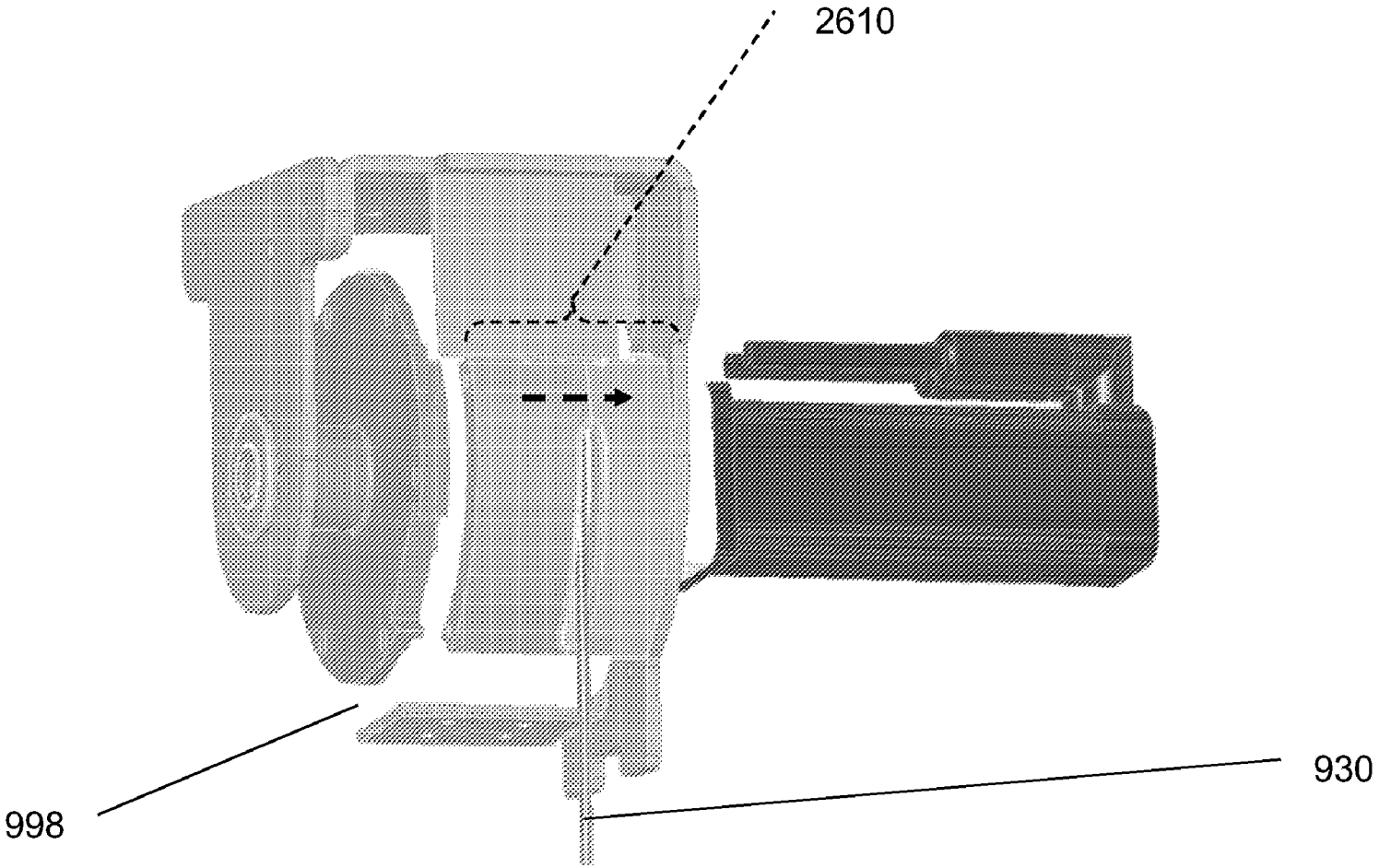
FIGS. 27-29 illustrate an alternative embodiment for sensing cable travel limits employing the gates of FIGS. 22 and 23.
Figure 28:
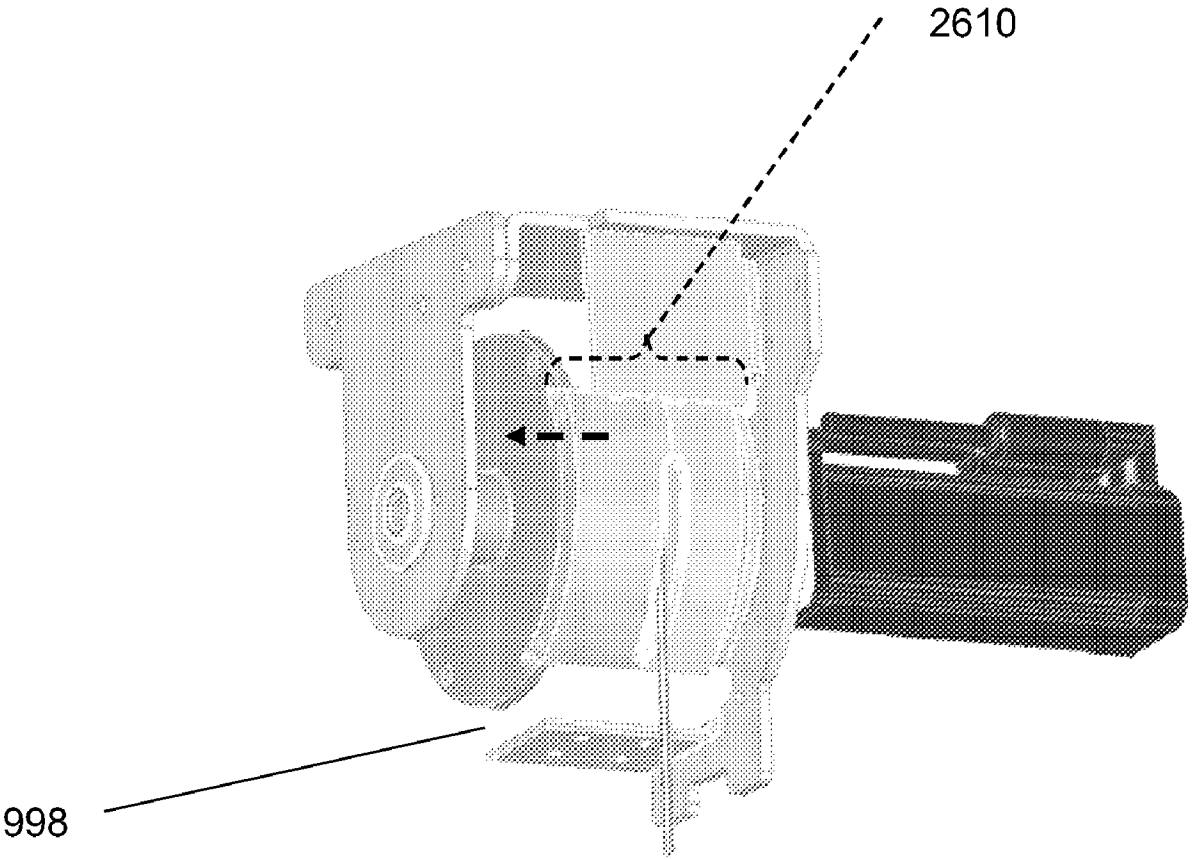
Figure 29:
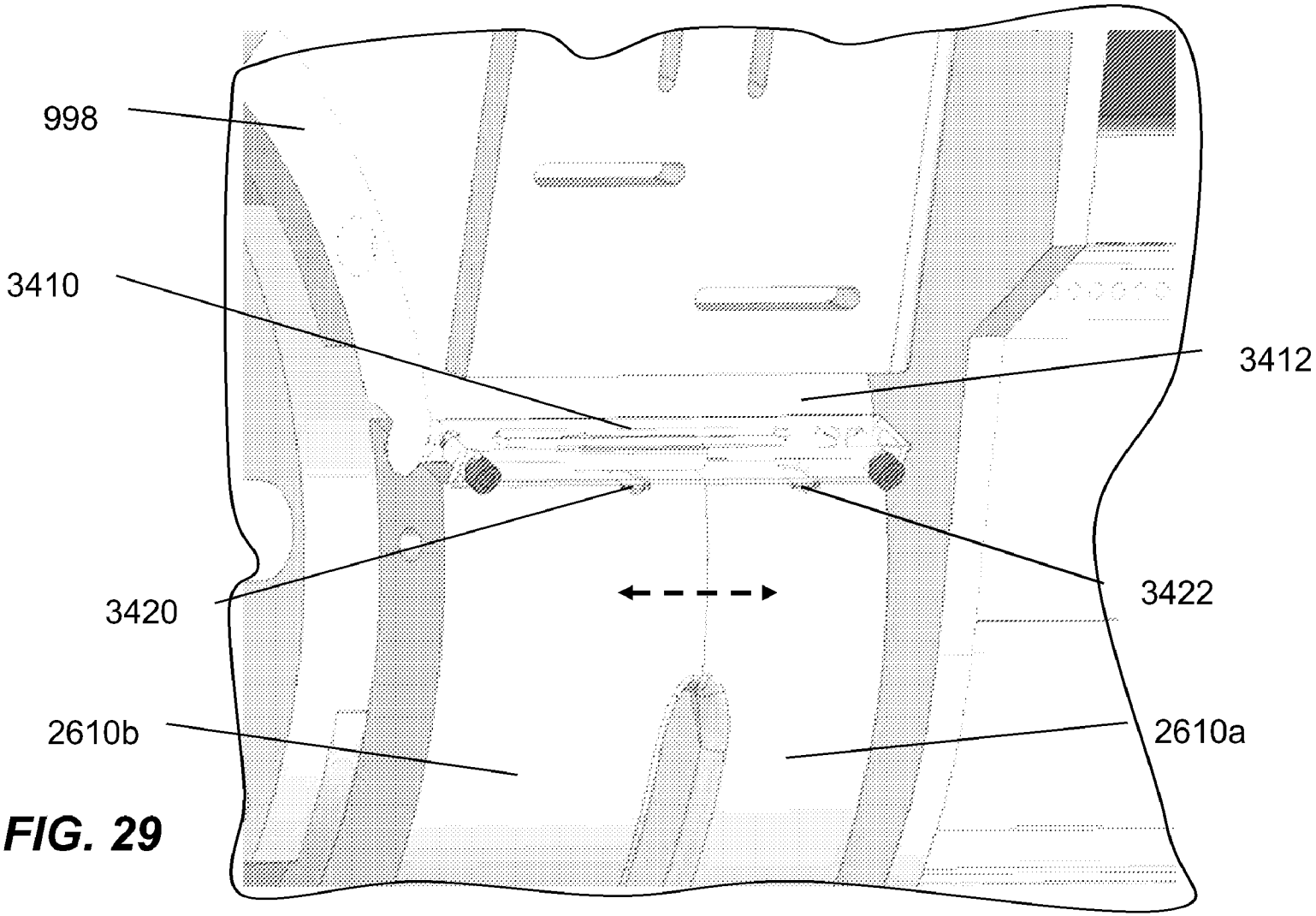

Although the micro switch mechanism is believed to be preferred, by virtue of its simplicity, it should be appreciated that alternative sensing systems such as a magnetic, non-contacting sensor may eliminate the contact force required to actuate the sensor and thus eliminating component wear may be employed. For example, as depicted in FIGS. 27-29, a magnetic sensor 3410 may be mounted stationary to the fixed wire rope drum cover 998. Along with two magnetic targets 3420 and 3422, that mount to the wire rope guide mechanism 2610, the sensor is operatively connected to the drum pulley. The sensor targets 3420, 3422 consist of one north and one south pole oriented magnet, and are suitable for similarly providing travel limit signals as discussed above. Other options for travel limit sensors include optical or other non-contact techniques, as well as conventional mechanical sensors and switches.

The various features and functions disclosed herein are preferably implemented using a controller or similar processing system suitable for operating under the control of programmatic code. One embodiment contemplates controller 150 (FIG. 1) having pre-loaded functionality for a wide range of features and functions, wherein one or more features and functions are enabled only as a result of a subsequent instruction or signal to the controller. In this way, the universal nature of the actuator 112 (including controller 150), may be further extended. The process or operation of preloading all software functionality and then only enabling what the customer wants or purchases, is believed to facilitate the intended interchangeability of components in accordance with an aspect of the present invention. Such a process would also allow the enablement of increased functionality after an actuator has been deployed in the field—for example when a customer's needs or application changes, the actuator can have additional features or functions enabled. It is also possible that in the event that a plug and play component was later attached to the actuator, the actuator would not only recognize the component as described above, but could alter its programmatic controls to facilitate use of the newly installed component. It is believed that these improvements will permit rapid customization of actuators to customer's requirements, while reducing or eliminating the need for custom software changes and ongoing support.

Returning to FIG. 12A, depicted therein is a further improvement to the operator control pendant or end-effector 116. In the embodiment depicted, the pendant 116 is fitted with a liquid crystal display (LCD) 3610 or similar display technology in order to provide the ability to communicate more readily-available information to a user. The information displayed in the LCD may include basic information such as system status (i.e.: system ready for use), advanced or optional information such as load weight, system usage and service information (i.e.: number of cycles completed and system service indicators) as well as enhanced guidance and feedback when in programming mode such as what feature is currently being programmed (i.e.: virtual limits).

By using the LCD it is possible to provide more and different information to the installer, the user and even maintenance staff. Once again, as an alternative to the LCD display, conventional light-emitting diodes (LEDs) and the like may be employed to communicate actuator status information to an operator.

In yet a further alternative embodiment, for example as depicted in FIG. 25, the wire rope is tightly constrained at all times between the drum pulley 111, the drum cover 998 and the sliding gates 2610, so that no space is available to allow a slack loop in the wire rope, anywhere in the actuator. Thus even a compressive load applied to the wire rope will not allow slack to form or accumulate within the actuator 112, as long as the anchored end is restrained from slipping out. Practically speaking, there is likely to be a small portion of the wire rope that remains free while inside the actuator and before exiting the gate, as it unwinds from the pulley and before exiting the actuator or drum housing. It will be further appreciated that the use of a larger diameter wire rope (e.g., 0.25 inch diameter rope helps in this regard, since it has more column strength than smaller diameter rope) reduces the capability of the rope for forming a loop (slack) when unconstrained for a short distance. Those skilled in the art will appreciate that the diameter of the rope is a function of the load capacity of the actuator and may be smaller or larger than 0.025 inches.

With additional functionality provided in the current controls, the system may also perform one or more hardware identification processes during power up, and may compare the resultant information against specified functionality. Using such information, the system may produce a warning message that can be displayed if issues are found such as inoperative or missing subsystems, for example, a missing handle or operator presence sensing being inoperative.

Again in view of the universal design intended for the various embodiments characterized herein, the present invention contemplates the use of a real-time I/O port assignment thru a flexible configuration setup, rather than modifying the source code program each time. Such a system would permit the user to access preprogrammed functionality within the controls to more rapidly configure the unit's I/O for their specific application. It is contemplated that a software interface may be provided to further simplify the ease and flexibility of application configuration.

It will be appreciated that various aspects of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A lift system with a configurable load-lifting capacity, comprising:

a controller;

an actuator, responsive to said controller, including a pulley with a cable affixed thereto and wound thereon in a single layer to support a load on a free end of said cable, where the pulley is driven by a motor and an associated transmission, said transmission comprising a building block gear reduction configuration, such that a combination of the motor and the building block gear reduction configuration determines the load-lifting capacity of the actuator; and a load interface, operatively connected to the end of said cable, said load interface including user controls and generating signals to be transmitted to said controller, wherein in response to the signals, said controller causes the operation of the actuator to raise and lower the load suspended from said actuator.

2. The lift system according to claim 1, further comprising a planetary gear reducer employed as the gear reduction of the transmission.

3. The lift system according to claim 1, further comprising a compressive load sensor, operatively associated with said actuator, wherein said sensor senses a compressive load from an element of the actuator in response to the load on the cable.

4. The lift system according to claim 3, wherein the element of the actuator comprises an arm that is associated with the pulley and associated motor and transmission, said arm being displaced in a rotational direction in response to the load.

5. The lift system according to claim 1, further comprising communication circuitry associated with said controller, said communication circuitry permitting the controller to communicate with a remote computer.

6. The lift system according to claim 5, wherein the communications with said remote computer include the transmission of remote diagnostic information.

7. The lift system according to claim 1, wherein said actuator further comprises a sliding gate through which the free end of said cable leaves the pulley.

8. The lift system according to claim 7, wherein said sliding gate is operatively associated with the pulley so as to maintain registration when the pulley rotates and the cable is wound or unwound.

9. The lift system according to claim 8, wherein said gate traverses the pulley along a longitudinal direction in response to the rotation of the pulley, and further including at least one travel sensor suitable for sensing the position of said gate so as to determine the amount of said cable unwound from said pulley.

10. The lift system according to claim 9, wherein said at least one travel sensor generates a signal when the lift system has reached a travel limit.

11. A lift system, comprising:

a controller;

an actuator, said actuator being responsive to said controller, said actuator including a pulley with a cable wound thereon to support a load on a free end of said cable, where the pulley is driven by a motor and an associated transmission;

a load interface, operatively connected to the end of said cable, said load interface including user controls and generating signals to be transmitted to said controller, wherein in response to the signals, said controller causes the operation of the actuator to raise and lower the load suspended from said actuator; and a load cell operatively associated with said pulley for sensing only a compressive force in response to the load applied to the cable, said load cell producing a load signal that is transmitted to said controller, wherein said controller causes the operation of the actuator as a function of the load signal.

12. A lift system, comprising:

a controller;

an actuator, said actuator being responsive to said controller, said actuator including a pulley with a cable wound thereon to support a load on a free end of said cable, where the pulley is driven by a motor and an associated transmission;

a load interface, operatively connected to the end of said cable, said load interface including user controls and generating signals to be transmitted to said controller, wherein in response to the signals, said controller causes the operation of the actuator to raise and lower the load suspended from said actuator, where at least one user control generates a signal using a coil to sense the relative motion of a core and where the core is connected to a slideable handle using a flexible component; and a load cell operatively associated with said pulley for sensing a compressive force, said load cell producing a load signal that is transmitted to said controller, wherein said controller causes the operation of the actuator as a function of the load signal.

13. The lift system according to claim 12, further comprising a rotating slip ring assembly providing for the transmission of electrical signals, and a pressurized fluid therethrough.

14. The lift system according to claim 12, further comprising a reflective photoelectric sensor suitable for sensing the presence of an operator's hand on said handle.

15. The lift system according to claim 12, further comprising a liquid crystal display on said load interface said display depicting information transmitted from said controller.

16. A lift system, comprising:

a controller;

an actuator, said actuator being responsive to said controller, said actuator including a pulley with a cable wound thereon to support a load on a free end of said cable, where the pulley is driven by a motor and an associated transmission, wherein said actuator further comprises a sliding guide operatively associated with the pulley so as to maintain registration when the pulley rotates and the cable is wound or unwound; and a load interface, operatively connected to the end of said cable, said load interface including user controls and generating signals to be transmitted to said controller, wherein in response to the signals, said controller causes the operation of the actuator to raise and lower the load suspended from said actuator.

17. The lift system according to claim 16, wherein said guide traverses the pulley along a longitudinal direction in response to the rotation of the pulley, and further including at least one travel sensor suitable for sensing the position of said guide so as to indicate the amount of said cable unwound from said pulley.

18. The lift system according to claim 17, wherein said at least one travel sensor generates a signal when the lift system has reached a travel limit.

19. A lift actuator, comprising:

a controller;

an electrical motor for driving the actuator, said motor operating in response to control signals from the controller, to drive a drum upon which a wire rope is wound;

an operator interface, attached near an unwound end of the wire rope, said operator interface including a detachable lifting tool, wherein the operator interface provides signals from the operator to the controller to control the operation of the actuator a frame for rotatably suspending the entire drive assembly comprising the motor, reduction and drum;

a load sensor attached to the frame, for sensing the load as a result of rotation of the entire drive assembly when a load is applied to the unwound end of the wire rope;

a slack sensor for sensing the angle of orientation or rotation of the entire drive assembly and determining when a slack condition is present in response to a signal from the slack sensor;

a universal motor and reducer assembly that may be fitted with one of a plurality of additional reducers in order to alter the capacity range of the actuator;

a planetary reducer, wherein the planetary configuration of the reducer is substantially enclosed within the rope pulley drum;

a cable guide for controlling the position of the cable upon being wound or unwound from the drum;

a cable limit sensor, triggered in response to the lateral movement of the cable guide as the cable is wound or unwound;

the cable guide including a plurality of threads for mating with grooves on the drum to provide the lateral force to move the guide as the cable is wound and unwound.

20. The lift actuator of claim 19, wherein the operator interface further comprises:

a handle;

a pivotable coupling for attaching the interface to the rope, but permitting 360-degree rotation thereof relative to the rope;

a pancake-like slip ring suitable for providing electrical contacts and an air channel or conduit therewith;

a coil sensor for sensing a vertical component of a displacement applied to the handle, wherein the handle is coupled to a core passing within the coil by a flexible filament; and a liquid crystal display on the interface to display status information to an operator;

a non-contact, proximity sensor for detecting the presence of an operator's hand on the handle during operation.

* * * * *